US006810973B2

(12) United States Patent
Sved

(10) Patent No.: US 6,810,973 B2
(45) Date of Patent: Nov. 2, 2004

(54) STEERABLE HORIZONTAL SUBTERRANEAN DRILL BIT HAVING OFFSET CUTTING TOOTH PATHS

(75) Inventor: John B. Sved, West Haven, UT (US)

(73) Assignee: Hard Rock Drilling & Fabrication, L.L.C., Syracuse, UT (US)

( * ) Notice: Subject to any disclaimer, the term of this patent is extended or adjusted under 35 U.S.C. 154(b) by 0 days.

(21) Appl. No.: 10/209,364

(22) Filed: Jul. 31, 2002

(65) Prior Publication Data

US 2003/0150651 A1 Aug. 14, 2003

Related U.S. Application Data

(60) Provisional application No. 60/355,153, filed on Feb. 8, 2002.

(51) Int. Cl.[7] ..... E21B 7/08; E21B 7/04; E21B 7/06

(52) U.S. Cl. ..... 175/74; 175/399; 175/413; 175/62

(58) Field of Search ..... 175/45, 61, 62, 175/73, 74, 393, 398–400, 412, 413

(56) References Cited

U.S. PATENT DOCUMENTS

| | | | | |
|---|---|---|---|---|
| 2,704,204 A | | 3/1955 | Koontz | 255/319 |
| 4,303,994 A | | 12/1981 | Tanguy | 367/35 |
| 4,388,973 A | | 6/1983 | Winkelmann et al. | 175/321 |
| 4,422,794 A | | 12/1983 | Deken | 403/330 |
| 4,475,604 A | | 10/1984 | Albertson et al. | 175/85 |
| 4,479,564 A | | 10/1984 | Tanguy | 181/105 |
| 4,527,637 A | | 7/1985 | Bodine | 175/55 |
| 4,546,837 A | | 10/1985 | Childers et al. | 175/340 |
| 4,621,698 A | * | 11/1986 | Pittard et al. | 175/305 |
| 4,637,479 A | | 1/1987 | Leising | 175/26 |
| 4,671,367 A | | 6/1987 | Brunsing et al. | 175/58 |
| 4,674,579 A | | 6/1987 | Geller et al. | |
| 4,714,118 A | | 12/1987 | Baker et al. | |
| 4,754,526 A | | 7/1988 | Tremoulet, Jr. et al. | |
| 4,787,463 A | | 11/1988 | Geller et al. | |
| 4,821,815 A | | 4/1989 | Baker et al. | |
| 4,856,600 A | | 8/1989 | Baker et al. | |
| 4,864,293 A | | 9/1989 | Chau | |
| 4,867,255 A | | 9/1989 | Baker et al. | |
| 4,896,733 A | | 1/1990 | Baker et al. | |
| 4,913,247 A | | 4/1990 | Jones | |
| 4,924,609 A | | 5/1990 | Martin | |
| 4,941,538 A | | 7/1990 | King | |
| 4,945,999 A | | 8/1990 | Malzahn | |
| 4,953,638 A | | 9/1990 | Dunn | |
| 4,955,439 A | * | 9/1990 | Kinnan | 175/45 |
| 4,989,681 A | | 2/1991 | Lohmuller et al. | |
| 5,020,608 A | * | 6/1991 | Oden et al. | 175/21 |
| 5,052,503 A | | 10/1991 | Lof | |
| 5,070,462 A | | 12/1991 | Chau | |
| 5,070,948 A | | 12/1991 | Malzahn et al. | |
| 5,090,492 A | | 2/1992 | Keith | |
| 5,099,274 A | | 3/1992 | Mirlieb et al. | |

(List continued on next page.)

*Primary Examiner*—David Bagnell
*Assistant Examiner*—Jennifer H Gay
(74) *Attorney, Agent, or Firm*—Daniel P. McCarthy; Parsons Behle & Latimer

(57) ABSTRACT

Various steerable horizontal subterranean drill bit apparatuses, which may have a drill bit, a housing and a one-bolt attachment system, or other features.

20 Claims, 22 Drawing Sheets

U.S. PATENT DOCUMENTS 5,099,929 A 3/1992 Keith et al.
5,133,148 A 7/1992 Lawson
5,133,417 A 7/1992 Rider
5,147,001 A 9/1992 Chow et al.
5,148,875 A 9/1992 Karlsson et al.
5,148,880 A 9/1992 Lee et al.
5,163,520 A 11/1992 Gibson et al.
5,172,771 A 12/1992 Wilson
5,174,033 A 12/1992 Rider
5,203,418 A 4/1993 Gibson et al.
5,220,964 A 6/1993 Deken et al.
5,226,488 A 7/1993 Lessard et al.
5,242,026 A 9/1993 Deken et al.
5,244,049 A 9/1993 Rodert et al.
5,253,721 A 10/1993 Lee
5,259,469 A 11/1993 Stjernstrom et al.
5,279,371 A 1/1994 Ekwall et al.
5,311,952 A 5/1994 Eddison et al.
5,327,636 A 7/1994 Wilson
5,341,887 A 8/1994 Deken et al.
5,359,324 A 10/1994 Clark et al.
5,368,108 A 11/1994 Aldred et al.
5,390,750 A 2/1995 Deken et al.
5,392,868 A 2/1995 Deken et al.
5,421,420 A 6/1995 Malone et al.
5,449,046 A 9/1995 Kinnan
5,467,832 A 11/1995 Orban et al.
5,469,926 A 11/1995 Lessard
5,484,029 A 1/1996 Eddison
5,490,569 A 2/1996 Brotherton et al.
5,494,123 A 2/1996 Nguyen
5,520,256 A 5/1996 Eddison
5,529,133 A 6/1996 Eddison
5,530,359 A 6/1996 Habashy et al.
5,538,091 A 7/1996 Theocharopoulos
5,542,482 A 8/1996 Eddison
5,558,170 A 9/1996 Thigpen et al.
5,617,926 A 4/1997 Eddison et al.
5,671,817 A 9/1997 Smith et al.
5,709,276 A 1/1998 Lee
5,713,423 A 2/1998 Martin et al.
5,720,355 A 2/1998 Lamine et al.
5,727,641 A 3/1998 Eddison et al.
5,755,297 A 5/1998 Young et al.
5,794,719 A 8/1998 Holloway
5,799,740 A 9/1998 Stephenson et al.
5,839,525 A 11/1998 Hoffmaster
5,857,710 A 1/1999 Leising et al.
5,881,830 A 3/1999 Cooley
5,899,283 A 5/1999 Cox
5,931,240 A 8/1999 Cox
5,941,322 A 8/1999 Stephenson et al.
5,950,743 A 9/1999 Cox
5,957,223 A 9/1999 Doster et al.
5,963,036 A 10/1999 Wu et al.
5,992,545 A 11/1999 Ekwall
6,003,622 A 12/1999 Stjernstrom
6,033,162 A 3/2000 Uebele et al.
6,039,131 A 3/2000 Beaton
6,047,784 A 4/2000 Dorel
6,059,054 A 5/2000 Portwood et al.
6,073,711 A 6/2000 Ingmarsson
6,092,610 A 7/2000 Kosmal et al.
6,109,371 A 8/2000 Kinnan
6,109,372 A 8/2000 Dorel et al.
6,123,160 A 9/2000 Tibbitts
6,158,529 A 12/2000 Dorel
6,176,329 B1 1/2001 Portwood et al.
6,179,065 B1 1/2001 Payne et al.
6,186,251 B1 2/2001 Butcher
6,206,116 B1 3/2001 Saxman
6,209,660 B1 4/2001 Cox
6,230,557 B1 5/2001 Ciglenec et al.
6,230,828 B1 5/2001 Beuershausen et al.
6,250,403 B1 6/2001 Beckwith
6,250,404 B1 6/2001 Gunsaulis
6,263,983 B1 * 7/2001 Wentworth et al. ..... 175/19
6,297,639 B1 10/2001 Clark et al.
6,308,789 B1 10/2001 Kuenzi et al.
RE37,450 E 11/2001 Deken et al. ..... 175/62
6,311,790 B1 * 11/2001 Beckwith et al. ..... 175/62
6,328,117 B1 12/2001 Berzas et al.
6,332,498 B1 12/2001 George
6,334,485 B1 1/2002 George
6,338,390 B1 1/2002 Tibbitts
6,450,269 B1 * 9/2002 Wentworth et al. ..... 175/61
RE37,975 E * 2/2003 Stephenson et al. ..... 175/62
2002/0011357 A1 * 1/2002 Trueman et al. ..... 175/67
2002/0060095 A1 * 5/2002 Wentworth et al. ..... 175/73

* cited by examiner

STEERABLE HORIZONTAL SUBTERRANEAN DRILL BIT HAVING OFFSET CUTTING TOOTH PATHS

CROSS REFERENCE TO RELATED APPLICATIONS

Priority is hereby claimed to U.S. Provisional Patent Application Ser. No. 60/355,153 filed on Feb. 8, 2002.

BACKGROUND

When installing underground cables, wire and pipe, it is often uneconomical or even impossible to employ traditional excavation methods in order to bury the cable, wire or pipe. For example, when cable, wire or pipe is to be installed beneath existing roads, sidewalks or railroad tracks, the cost and expense of excavation and rebuilding is such that a construction project may be rendered impossible. Even when there are no such obstacles, it may be desirable for aesthetic, time, monetary and other reasons to install underground cable, wire, pipe or other device underground without disturbing the ground surface.

In order to address this need, the field of horizontal subterranean drilling has arisen. In order to install devices underground, first a generally horizontal underground bore hole is drilled beneath the ground at a desired depth (such as 2–15 feet). The bore hole may then be reamed out to any desired diameter. Next, the desired device is installed. Surface reclamation work is necessary only at the entry and the terminus of the bore hole.

SUMMARY

Several embodiments and several features of drill bit structures are depicted herein. Those features may be utilized singly or in combination to arrive at a steerable horiztonal subterranean drilling device which offers one or more advantages over existing steerable horizontal subterranean drilling devices. Objects, features and advantages of the devices and structures depicted herein will become apparent to persons of ordinary skill in the art upon reading this document in conjunction with the appended drawings, and upon utilizing and testing steerable horizontal subterranean drilling devices which incorporate one or more of the features described below.

DETAILED DESCRIPTION

The horizontal subterranean drilling field has several unique requirements. First, it is useful for the horizontal subterranean drilling device to be locatable. Various electronics are installed on the drilling device that can be detected above ground in order to determine the precise location of the drilling device.

Second, the horizontal subterranean drilling device may be steerable. Frequently, obstacles are present which the drilling device must avoid. A steering function permits the drilling device to steer up, down, left or right and avoid encountering known hard formations or pre-existing cable, wires and pipe.

Third, the drilling device may be capable of softening or breaking up and removing or pushing aside underground material in order to create a bore hole. This can be achieved by a combination of teeth or cutters rotating in combination with application of a drilling fluid.

Finally, the horizontal subterranean drilling device may be durable and long-lasting for convenience of use and economy.

Figure 1:
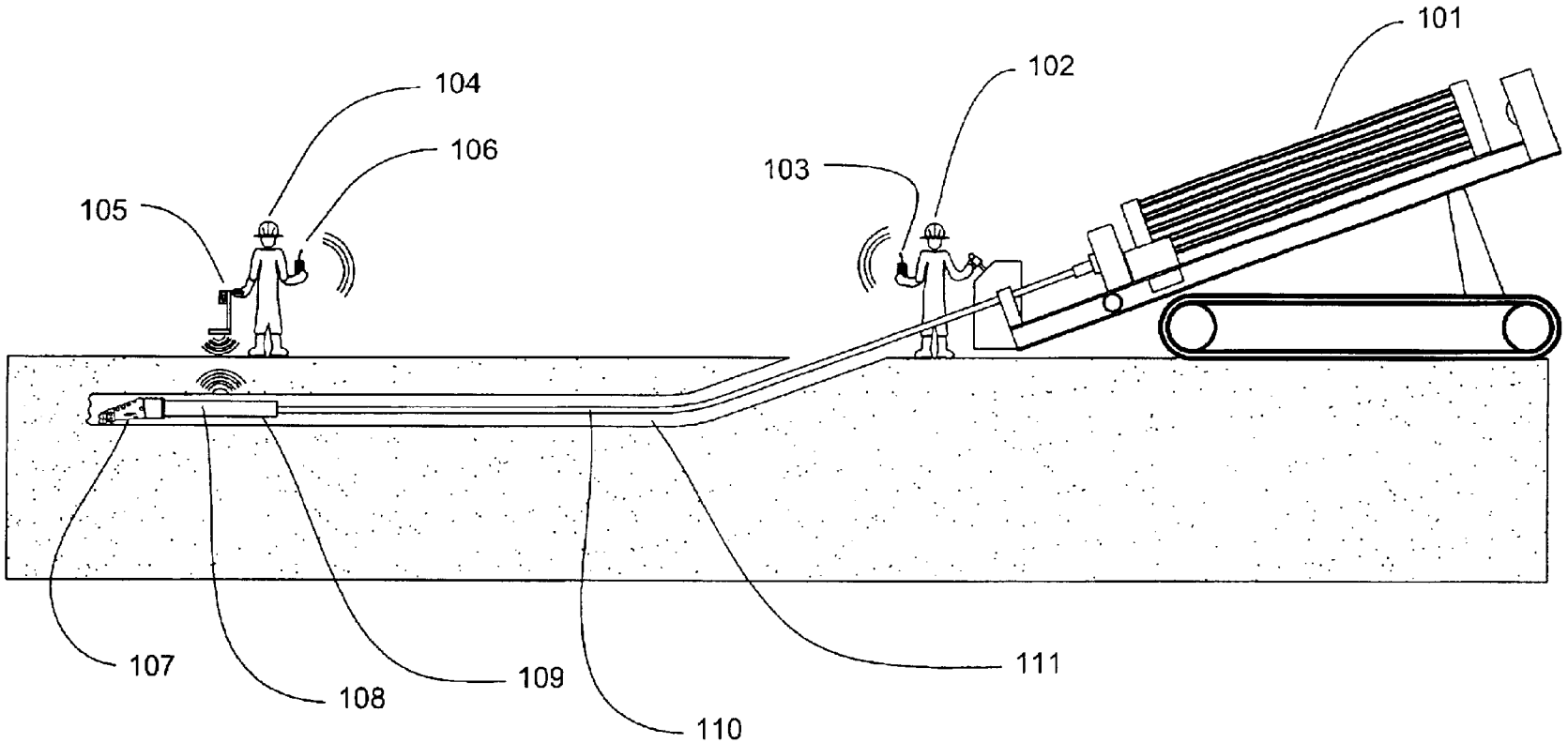
FIG. 1 depicts a side view of an example steerable horizontal subterranean drilling rig in operation.

FIG. 1 depicts a side view of a steerable horizontal subterranean drilling rig 101 in operation. The rig 101 includes a rig operator 102 at the rig in possession of a radio 103 for communication with a worker serving as a bit locator 104. The bit locator 104 has a radio 106 for communication with the rig operator 102. The bit locator 104 also has a bit detector 105 which senses signals emitted by electronics 108 located with the steerable horizontal subterranean drill bit housing 109. This permits the locator 104 to determine the planar position of the drill bit as well as its depth beneath the surface of the ground. The rig 101 has a power source for hydraulically forcing rod 110 through a subterranean bore 111 in the earth and to rotate a drill bit 107 within the bore 111 in order to drill the bore and increase the bore length on the distal end of the drill bit.

Figure 2A:
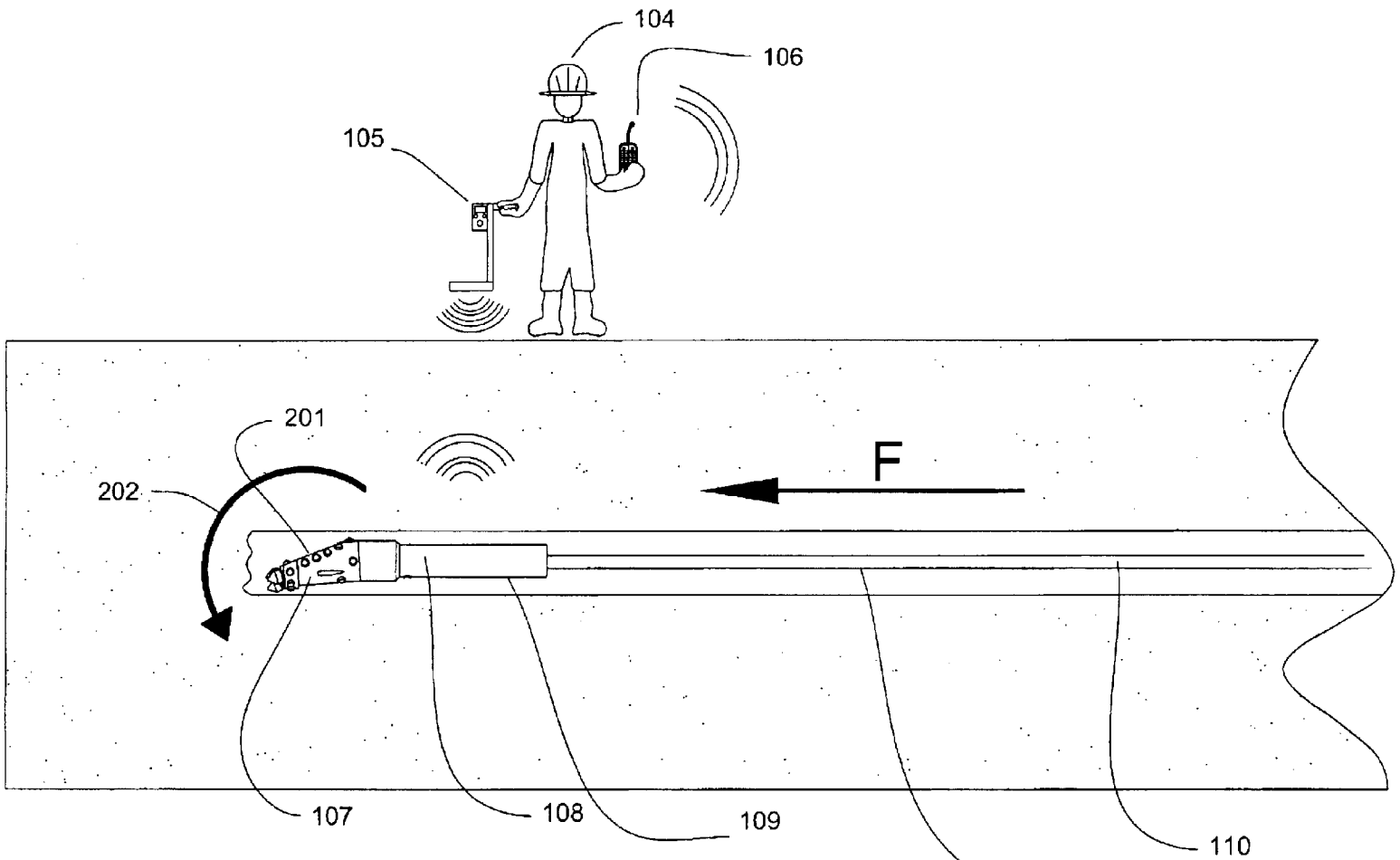
FIG. 2*a* depicts a side view of an example steerable horizontal subterranean drill bit being steered downward.

FIG. 2*a* depicts a side view of a steerable horizontal subterranean drill bit 107 being steered downward 202. In this figure a longitudinal force F is applied to the rod 110 by the rig 101 (not shown). When the bit is not being rotated for drilling effect, the force F causes the bit 107 to advance within the bore 111. In that instance, the steering face 201 of the bit will contact the earth along its angled surface forcing it to turn downward 202. Electronic communication between the electronics 108 within the housing 109 permits the bit locator 104 to detect by use of the bit detector 105 not only the longitudinal position of the bit 107, but also its angular orientation with respect to its longitudinal axis. By knowing the angular orientation of the bit 107, the bit locator 104 can determine which direction a longitudinal force F against the bit will tend to move it. Consequently, the bit locator 104 can use his radio 105 to instruct the rig operator 103 to rotate the bit about its longitudinal axis until a desired angular orientation of the bit is achieved in order to steer the bit in a desired direction.

Figure 2B:
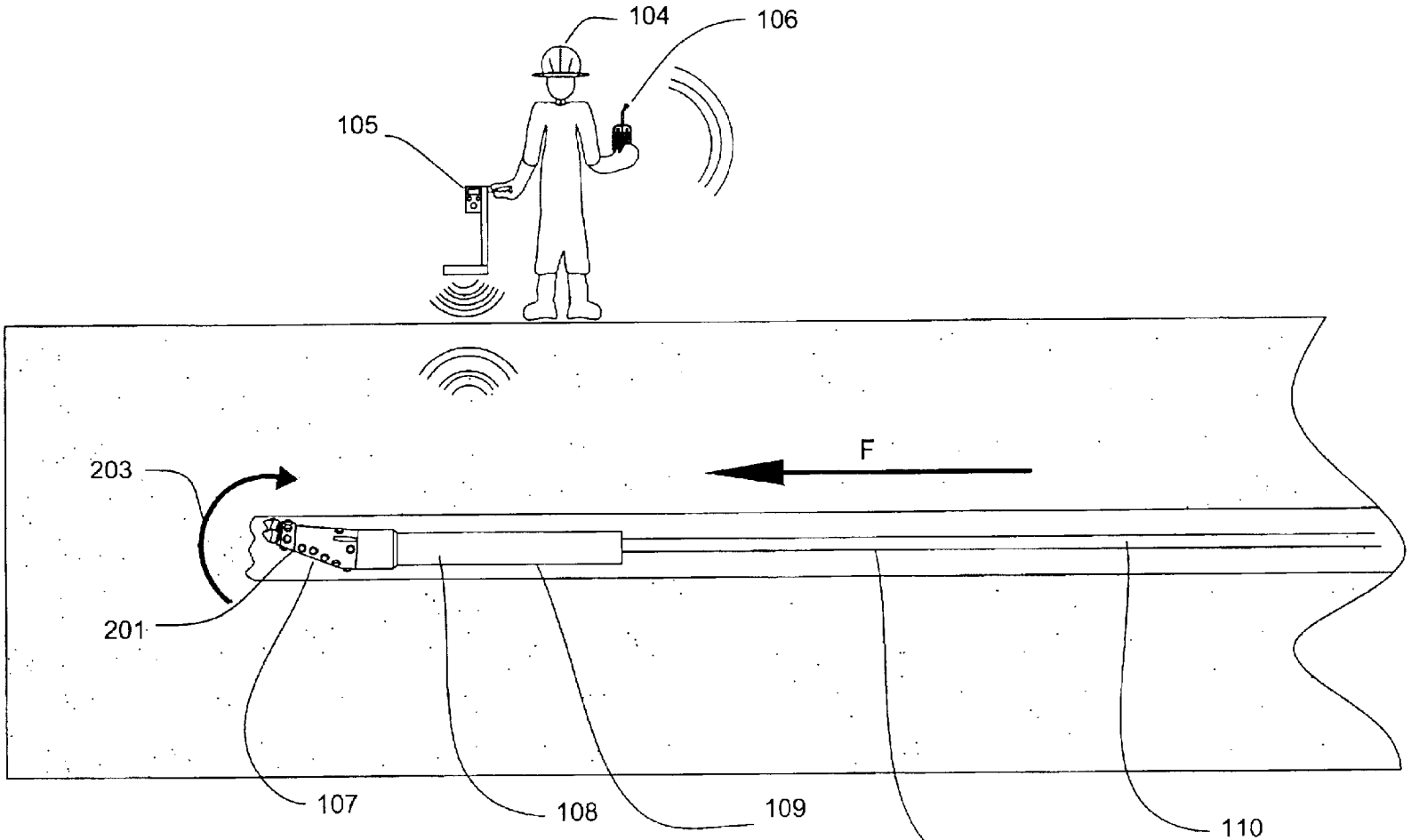
FIG. 2*b* depicts a side view of an example steerable horizontal subterranean drill bit being steered upward.

FIG. 2*b* depicts a side view of a steerable horizontal subterranean drill bit 107 being steered upward 203. Note that by changing the orientation of the steering face 201 to face downward, the bit can be forced by force F to turn upwards 203.

Figure 3A:
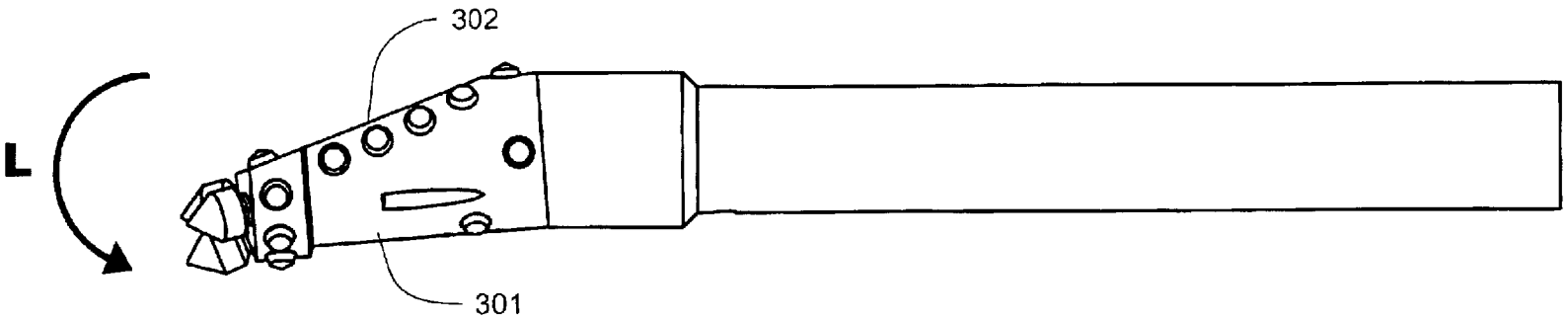
FIG. 3*a* depicts a top view of an example steerable horizontal subterranean drill bit being steered left.

FIG. 3*a* depicts a top view of a steerable horizontal subterranean drill bit 301 being steered left as indicated by arrow "L" by application of a longitudinal force along the longitudinal axis of the bit forcing the steering face 302 against the earth and causing the desired turn.

Figure 3B:
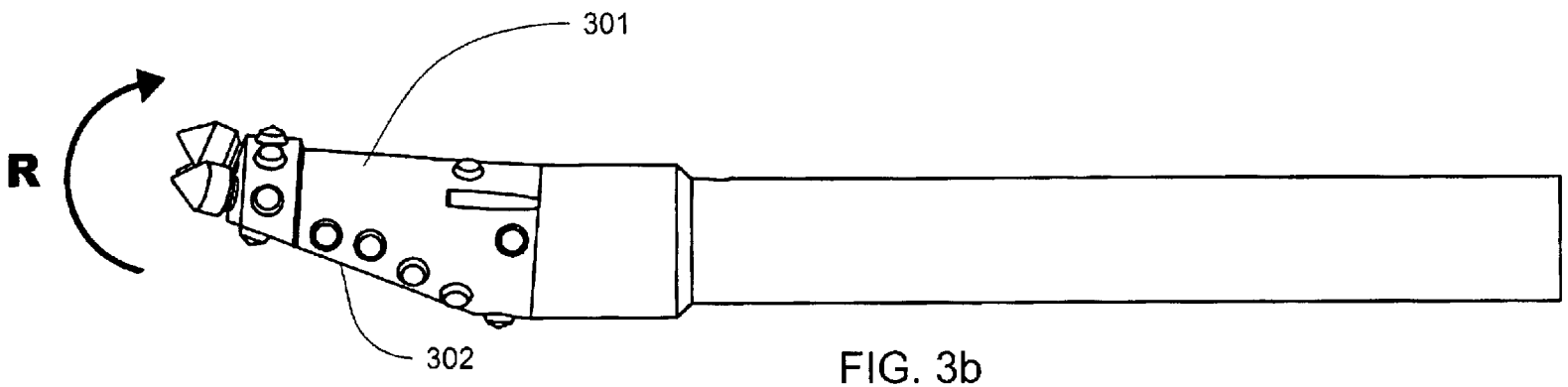
FIG. 3*b* depicts a top view of an example steerable horizontal subterranean drill bit being steered right.

FIG. 3*b* depicts a top view of a steerable horizontal subterranean drill bit 301 being steered right as indicated by arrow "R" by application of a longitudinal force along the longitudinal axis of the bit forcing the steering face 302 against the earth and causing the desired turn.

Figure 4A:
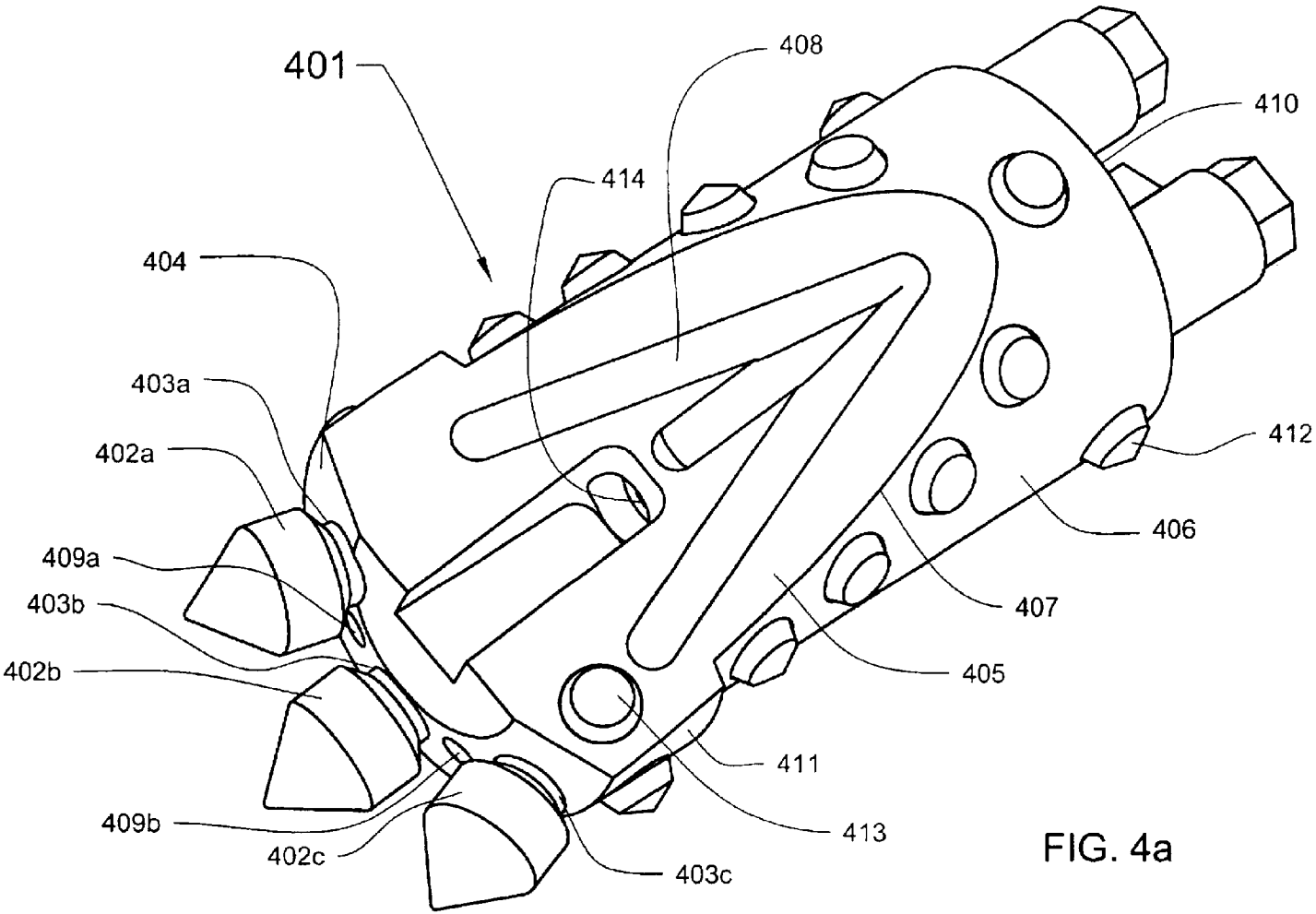
FIG. 4*a* depicts a perspective view of an example steerable horizontal subterranean drill bit, showing its cutting teeth, steering face and elevated wear protectors.

FIG. 4*a* depicts a perspective view of a steerable horizontal subterranean drill bit 401, showing its cutting teeth 402*a*, 402*b*, 402*c*, installed in receptacles 403*a*, 403*b*, 403*b* on the cutting face 404 of the bit. The angled steering face 405 of the bit is depicted. The steering face 405 is generally planar and intersects the shank 406 in the shape of a parabola 407. The steering face may include a tripartite drilling fluid flow channel 408 that permits drilling fluid which has exited the drilling fluid ports 409*a* and 409*b* on the cutting face 404 to pass by the steering face 405 in order to reach the housing (not shown) and provide it with some cooling and friction reduction. The bit 401 includes a mounting face 410 at the bit proximal end, followed by a shank region 406 and steering face 405, followed by a crown 411 and finally a cutting face 404 at the bit distal end. The crown 411 has a greater circumferential dimension during bit rotation than the shank 406. The bit also includes a plurality of elevated wear protectors 412 at locations on the shank and crown where abrasive wear of the bit is most likely in order to protect the bit from contact with earth and the associated abrasive wear. Further, an elevated wear protector 413 is provided at the leading edge or leading corner of the steering face 405 for wear protection. A bore 414 extending longitudinally through the bit along its longitudinal axis is provided to accommodate the one bolt attachment system.

Figure 4B:
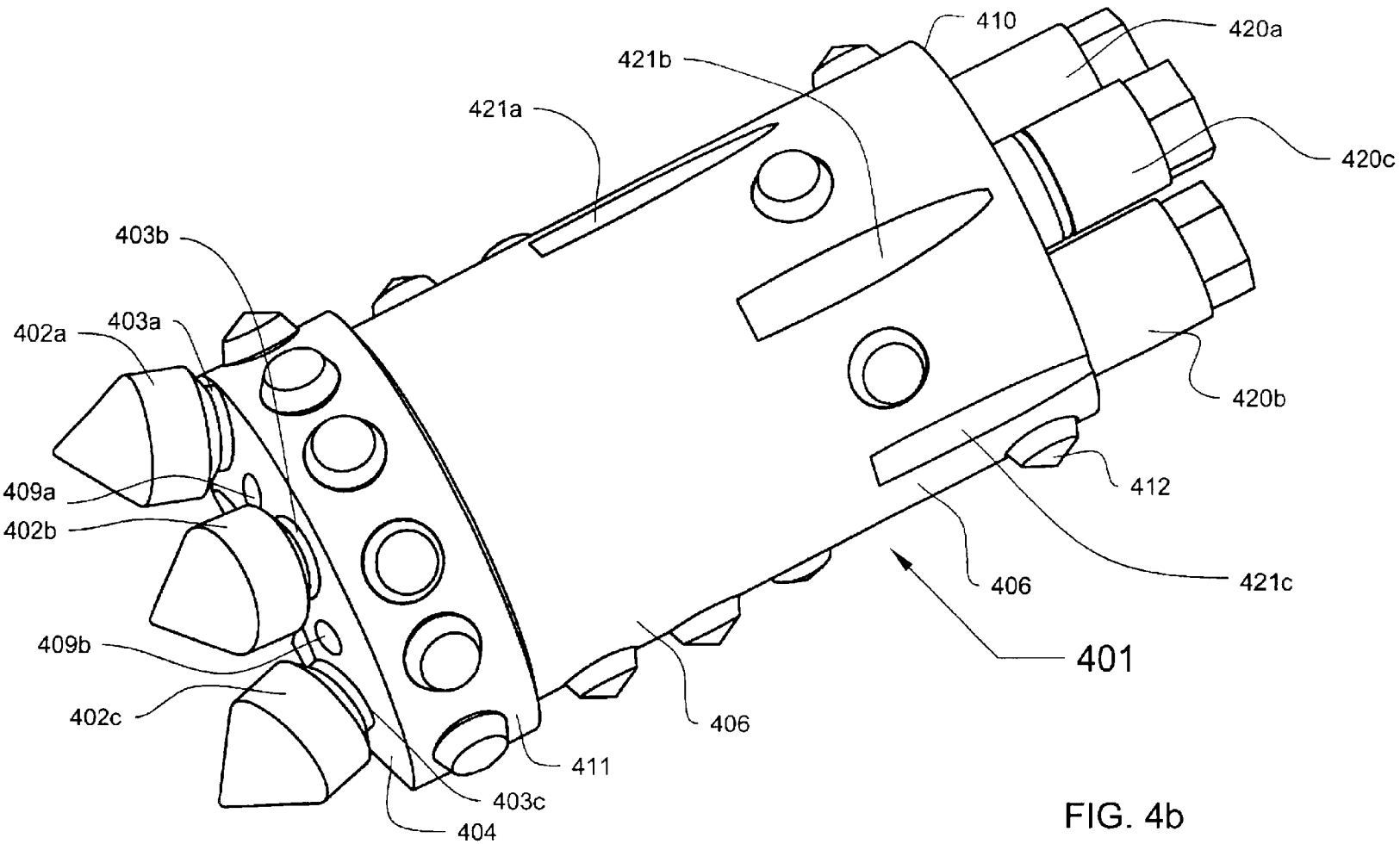
FIG. 4*b* depicts a perspective view of an example steerable horizontal subterranean drill bit, showing its cutting teeth, crown, shank and elevated wear protectors.

FIG. 4*b* depicts a perspective view of a steerable horizontal subterranean drill bit 401 from the opposite side of FIG. 4*a*, so that the shank 406 and crown 411 are more visible. The shank 406 includes three cutting tooth removal bores 421*a*, 421*b* and 421*c* which extend to the receptacles 403*a*, 403*b* and 403*c* so that a pin or punch may be used to drive the cutting teeth 402*a*, 402*b* and 403*c* from the bit for replacement. The shank 406 is generally cylindrical having a radius R1 (not shown), except for its transition into a steering face 405. The crown 411 is generally cylindrical having a radius R2 (not shown), where R2>R1. The crown is of greater diameter than the shank to avoid the condition that wear at the distal end of the drill bit could invade the cutting teeth receptacles 403*a*, 403*b*, 403*c*. On the mounting face 410 of the drill bit, a plurality of locator studs or bolts 420*a*, 420*b* and 420*c* are shown. The locator studs or bolts are fixed to the bit 401 and project into corresponding receptacles in a housing (not shown) to rotationally secure the bit with respect to the housing for drilling. The studs 420*a*, 420*b* and 420*c* may be threaded for threading into receptacles in the mounting face 410, and may have wrench flats on their proximal ends to permit tightening into such threads.

Figure 5A:
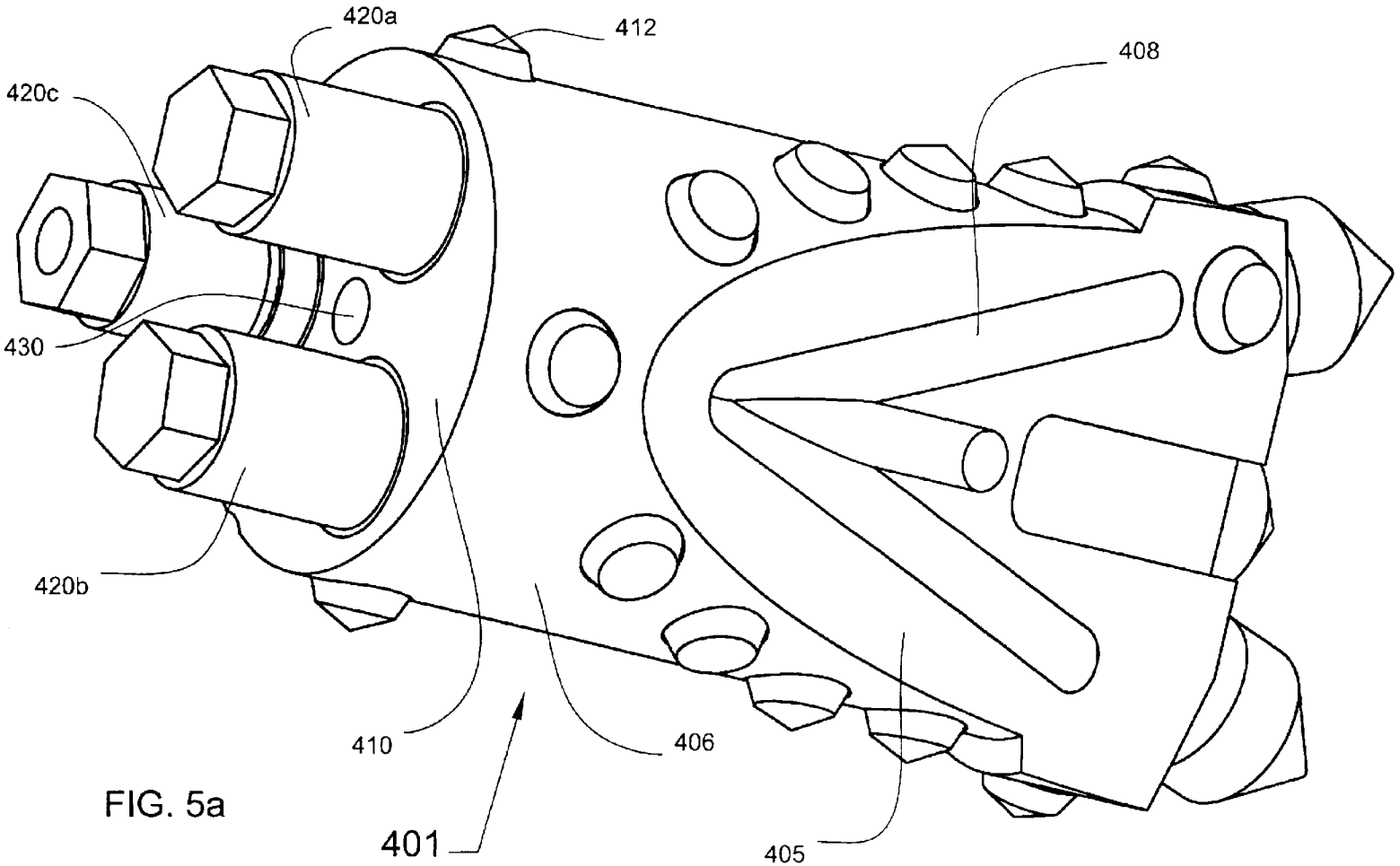
FIG. 5*a* depicts a perspective view of an example steerable horizontal subterranean drill bit, showing a portion of its shank, its steering face, its elevated wear protectors, its mounting face, and locating studs on the mounting face.

FIG. 5*a* depicts a perspective view of a steerable horizontal subterranean drill bit 401, showing the structures explained above as well as the proximal entrance 430 of the bore 414 (from FIG. 4*a*) that accommodates the one bolt attachment system. The bore passes from the cutting face 404 to the mounting face 410. The bore may lie along the longitudinal axis of the drill bit and is explained in greater detail later herein.

Figure 5B:
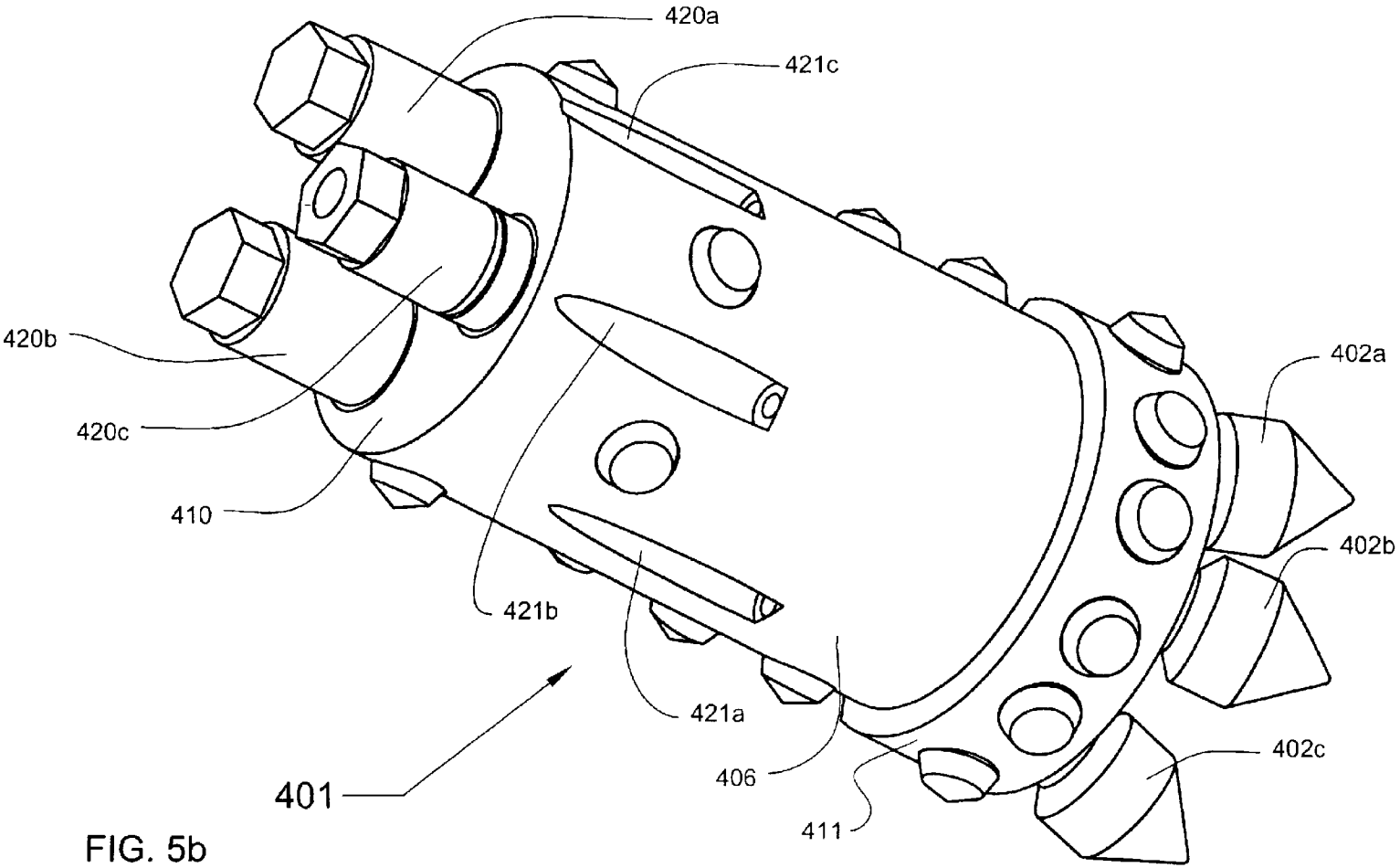
FIG. 5*b* depicts a perspective view of an example steerable horizontal subterranean drill bit showing its shank, crown, its cutting teeth, its elevated wear protectors, its mounting face, and locating studs on the mounting face.

FIG. 5*b* depicts a perspective view of a steerable horizontal subterranean drill bit 401 from the opposite side of FIG. 5*a* and depicting structures already explained above. Through the figures, note the positioning of elevated wear protectors near any discontinuities of the drill bit exterior surface, in order to avoid wear in those locations.

Figure 5D:
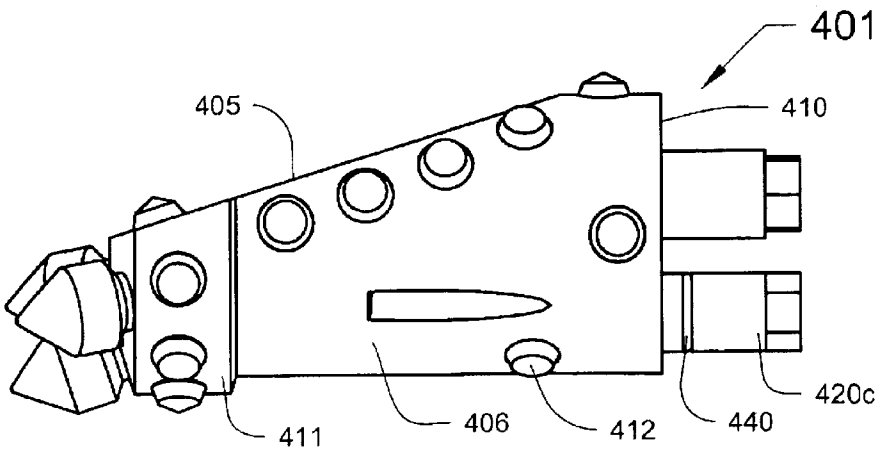
FIG. 5*d* depicts a left side view of an example steerable subterranean drill bit.
Figure 5F:
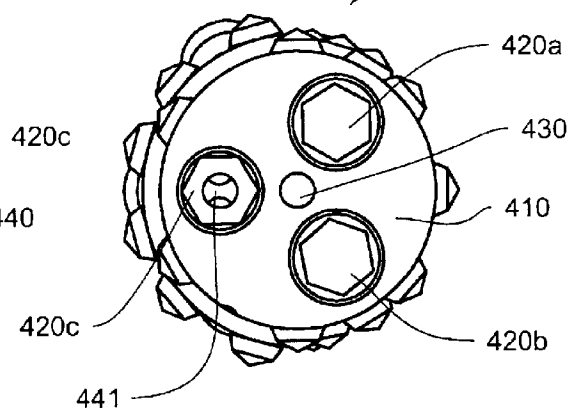
FIG. 5*f* depicts a rear end view (proximal end) of an example steerable horizontal subterranean drill bit.
Figure 5C:
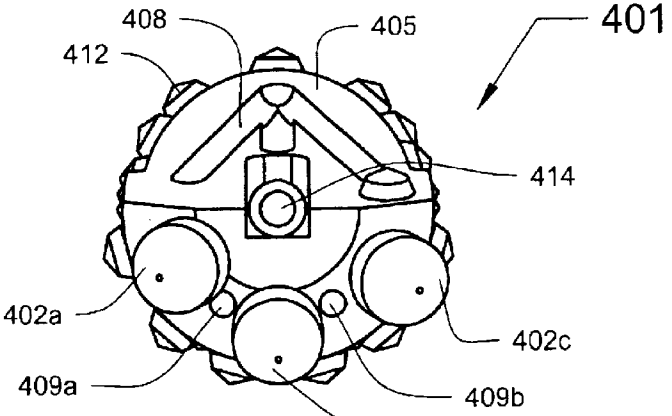
FIG. 5*c* depicts a front end view (distal end) of an example steerable horizontal subterranean drill bit.

FIG. 5*c* depicts a front end view (distal end) of a steerable horizontal subterranean drill bit 401, including bore 414 to accommodate the one bolt attachment system located concentric with the drill bit longitudinal axis. The drilling fluid flow channels 409*a* and 409*b* are shown. During drilling, fluid may flow from the housing out these channels to soften the earth to be drilled, to carry away earth, to lubricate and reduce friction and to cool the drill bit and housing.

FIG. 5*d* depicts a left side view of a steerable subterranean drill bit 401. From this view, it can be seen that locating stud or bolt 420*c* has a drilling fluid seal 440 located on its shank. The location of the seal 440 on the shank of the stud 420*c* has been chosen so that the seal 440 is offset a distance proximally from the plane of the mounting face 410 of the drill bit 401. By offsetting the seal 440 from the plane of the mounting face 410 where the drill bit and its housing meet, the seal is protected from dirt and debris, avoids damage, and is very long lasting.

Figure 5E:
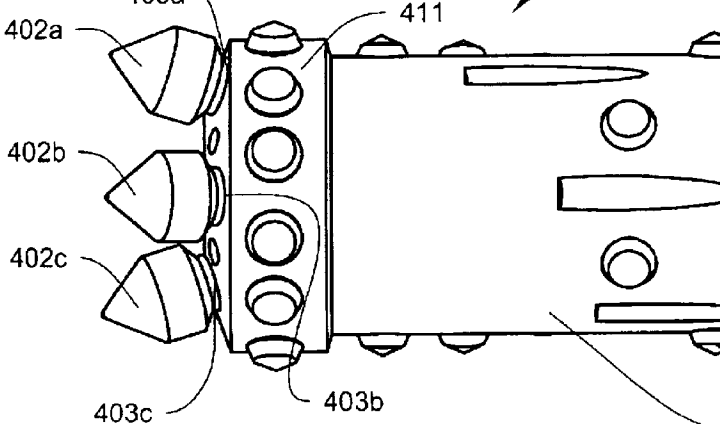
FIG. 5*e* depicts a bottom view of an example steerable subterranean drill bit.

FIG. 5*e* depicts a bottom view of a steerable subterranean drill bit 401 including structures already explained above.

FIG. 5*f* depicts a rear end view (proximal end) of a steerable horizontal subterranean drill bit 401. The locating stud or bolt 420*c* that includes the seal 440 has an internal bore 441 through which drilling fluid may flow and which seal 440 serves to seal from unwanted leakage. Drilling fliud can flow through the bore 441, through the bit body, and exit from the fluid flow channel exits 409*a* and 409*b*. An aperture 430 of the bore 414 for the one bolt attachment system can be seen.

Figure 6A:
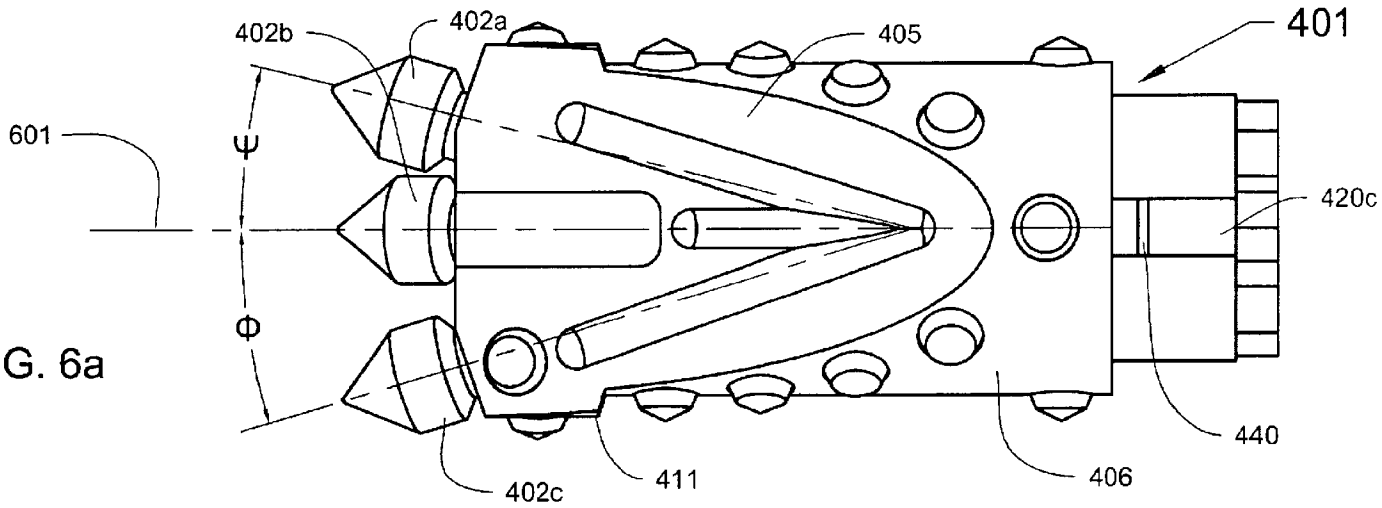
FIG. 6*a* depicts a top view of an example steerable horizontal subterranean drill bit including angular offset of the axis of a cutting tooth with respect to the drill bit longitudinal axis.

FIG. 6*a* depicts a top view of a steerable horizontal subterranean drill bit 401 with features explained above. The drill bit 401 has a longitudinal axis 601. The cutting teeth 402*a* and 402*c* may be arranged at different angular offsets $\psi$ and $\phi$ respectively with respect to the longitudinal axis 601 (where $\psi$ is not equal to $\phi$, or where $\psi=\phi$).

Figure 6B:
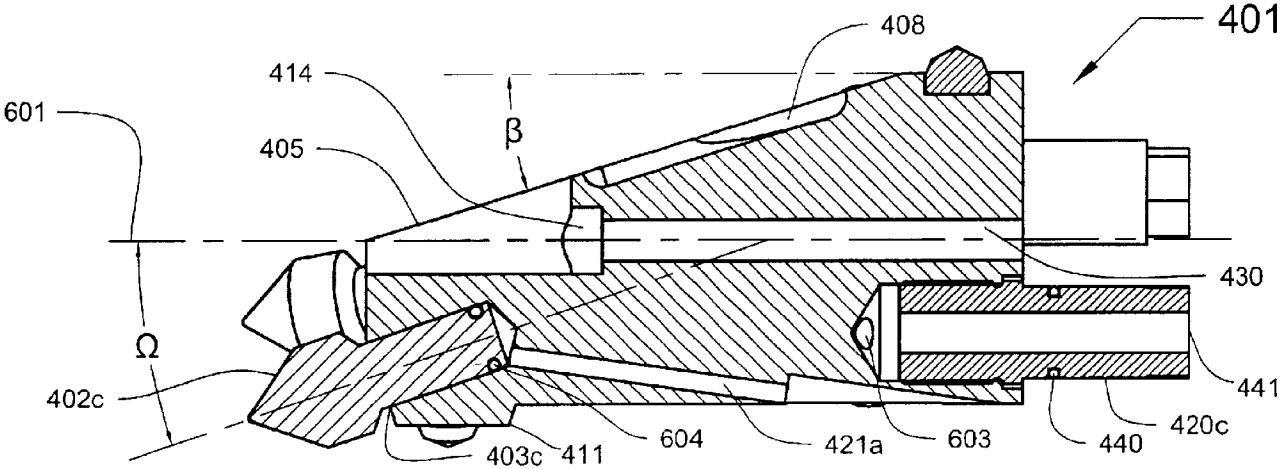
FIG. 6*b* depicts cross sectional left side view of an example steerable horizontal subterranean drill bit including angular offset of the steering face and the angular offset of the axis of the cutting teeth with respect to the drill bit longitudinal axis.

FIG. 6*b* depicts a cross sectional left side view of a steerable horizontal subterranean drill bit 401. It can be seen that the steering face 405 is oriented at an angular offset $\beta$ with respect to the longitudinal axis 601. It can also be seen that the cutting tooth 402*c* is oriented at an angular offset $\Omega$ with respect to the longitudinal axis 601. In some instances, $\psi$, $\phi$, $\beta$and $\Omega$ may all be the same angle, or they may differ substantially from each other. If the angle of the steering face matches the angular offset of the cutting teeth, steering of the drill bit will be most effective, otherwise the cutting teeth may interfere with the steering function. In one embodiment, the angles mentioned above are 19 degrees, although they could range from 10 to 30 degrees, from 15 to 25 degrees, or from 5 to 45 degrees or otherwise.

Also in FIG. 6*b*, it can be seen that cutting tooth 402*c* is held in place in its receptacle 403*c* by an o-ring 604 near its base. Use of an o-ring to secure the cutting teeth permits the cutting teeth to rotate within their receptacles and experience even wear during use and a longer useful life. The figure also permits a by cross sectional view of the locating stud 420*c* to be seen. The stud 420*c* has a bore 441 within it to permit drilling fluid to flow from a housing to a drill bit 401. Drilling fluid will exit the bore 441 through aperture 603 into drilling fluid passageways (not shown) in the bit 401. The seal 440 can also be seen in cross section. The bore 414 to 430 for the one bolt attachment system is also depicted.

Figure 6C:
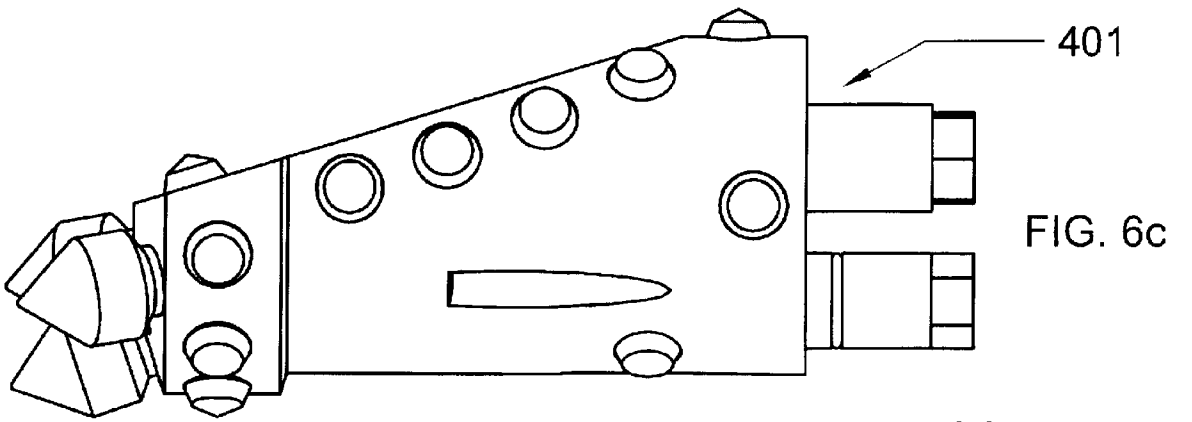
FIG. 6*c* depicts a left side view of an example steerable horizontal subterranean drill bit.

FIG. 6*c* depicts a left side view of a steerable horizontal subterranean drill bit 401 with structures already described.

Figure 6D:
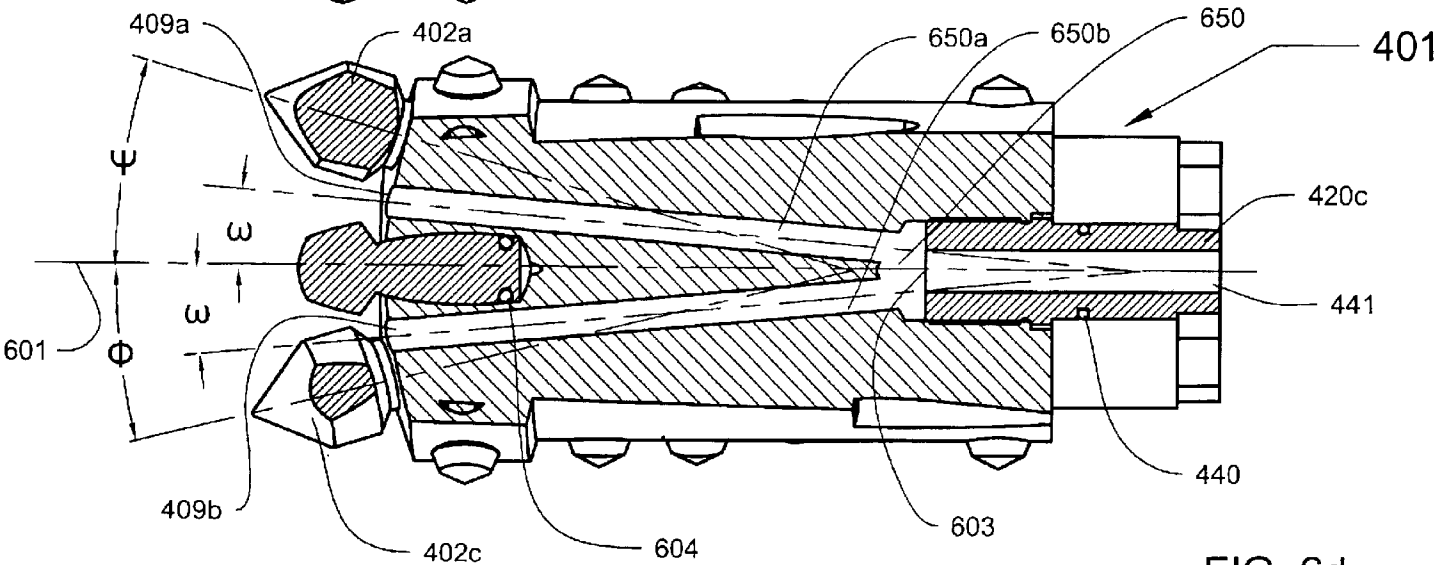
FIG. 6*d* depicts a cross sectional top view of an example steerable horizontal subterranean drill bit including both angular offset of the axis of the cutting teeth with respect to the drill bit longitudinal axis and the angular offset of the drilling fluid flow pathways with respect to the drill bit longitudinal axis.

FIG. 6*d* depicts a cross sectional top view of a steerable horizontal subterranean drill bit 401 including its longitudinal axis 601. The angular offsets of the axes $\psi$ and $\phi$ respectively of the cutting teeth 402*a* and 402*c* with respect to the drill bit longitudinal axis 601 are shown. Those offsets may be determined as previously mentioned above. The bit 401 also has a drilling fluid passageway or pathway 650 which receives drilling fluid from aperture 603 and transports it by v-shaped passageways 650*a* and 650*b* to exits, ports or apertures 409*a* and 409*b* where the drilling fluid may serve to soften and break up the earth and to lubricate and cool the cutting teeth and the drill bit. The drilling fluid passageways 650*a* and 650*b* are set at a desired angle $\omega$ to place the ports 409*a* and 409*b* in the desired locations, such as about 9.5 degrees with respect to the drill bit longitudinal axis 601. The angle $\omega$ may be any desired angle, such as an angle in the range of from about 5 degrees to about 75 degrees or otherwise.

Figure 6F:
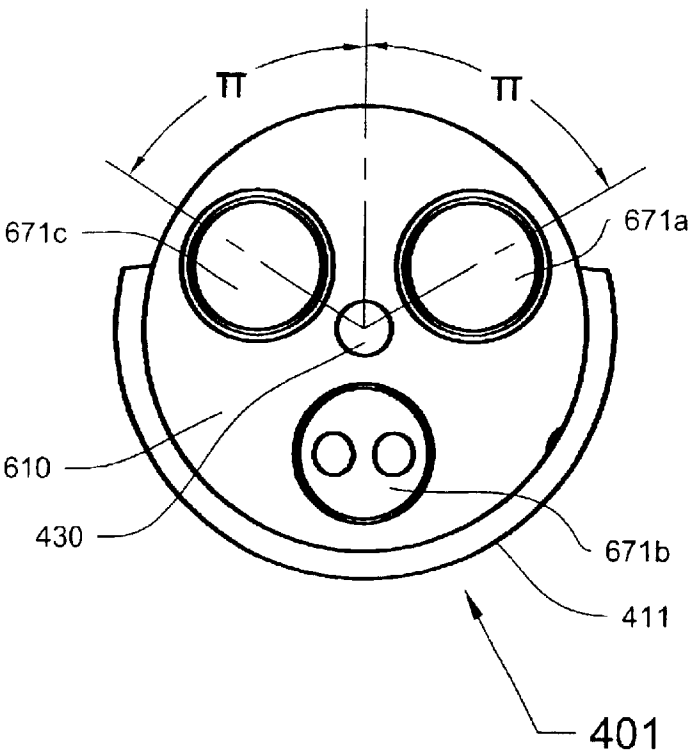
FIG. 6*f* depicts an rear end view (proximal end) of an example steerable horizontal subterranean drill bit without locating studs.
Figure 6E:
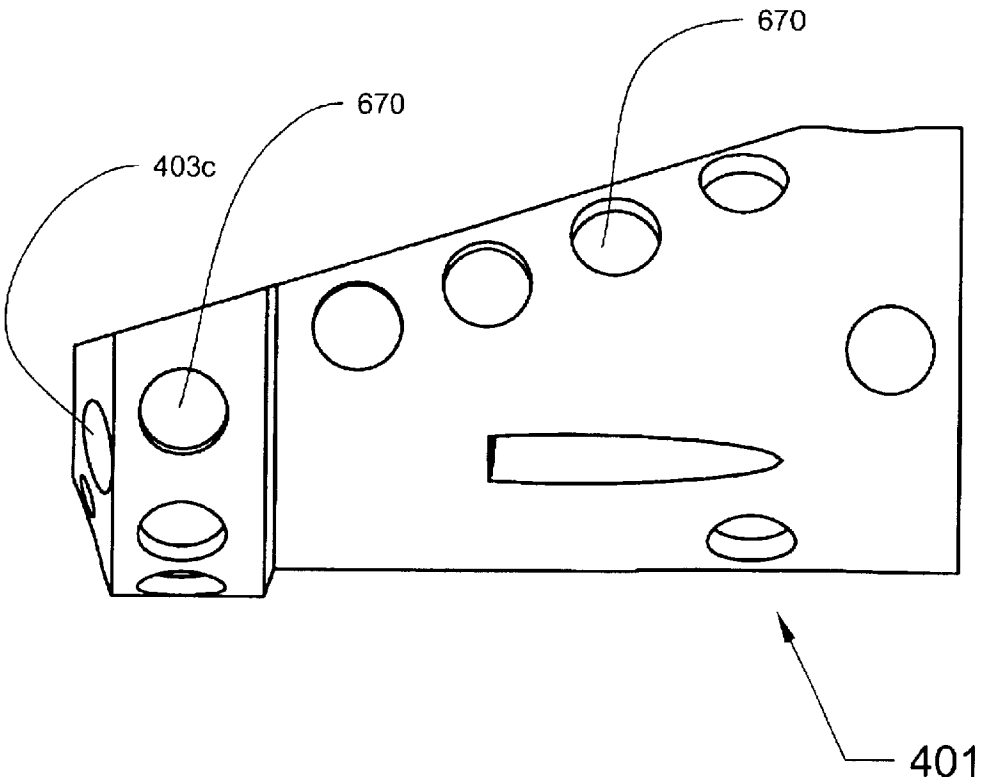
FIG. 6*e* depicts a side view of an example steerable horizontal subterranean drill bit without cutting teeth, elevated wear protectors or locating studs.

FIG. 6*e* depicts a side view of a steerable horizontal subterranean drill bit 401 without cutting teeth, elevated wear protectors or locating studs. Various receptacles 670 for wear protectors are depicted.

FIG. 6*f* depicts an rear end view (proximal end) of a steerable horizontal subterranean drill bit 401 without locating studs. Instead, receptacles 671*a*, 671*b* and 671*c* for the locating studs or bolts are shown. If locating studs are used, then the receptacles may be threaded. The receptacles are arranged on the drill bit mounting face 610 according to any desired angular offset. The angular offset π shown could be 120 degrees apart (equally spaced) or any other chosen arrangement, such as regular or irregular spacing. More or fewer locating studs than those shown could be used.

Figure 6H:
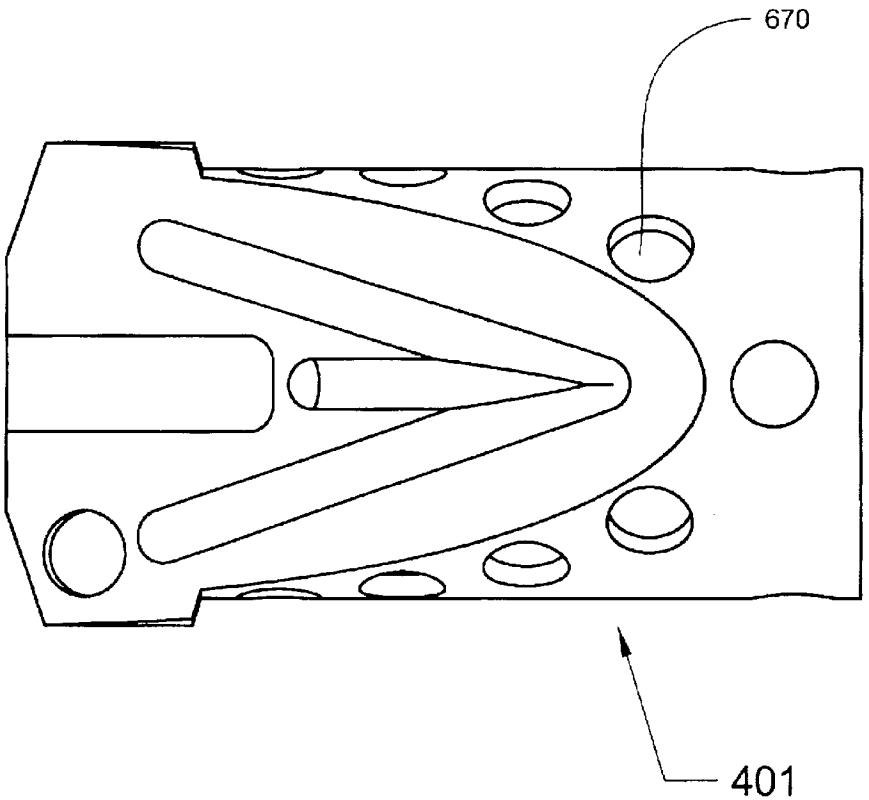
FIG. 6*h* depicts a top view of an example steerable horizontal subterranean drill bit without cutting teeth or elevated wear protectors.
Figure 6G:
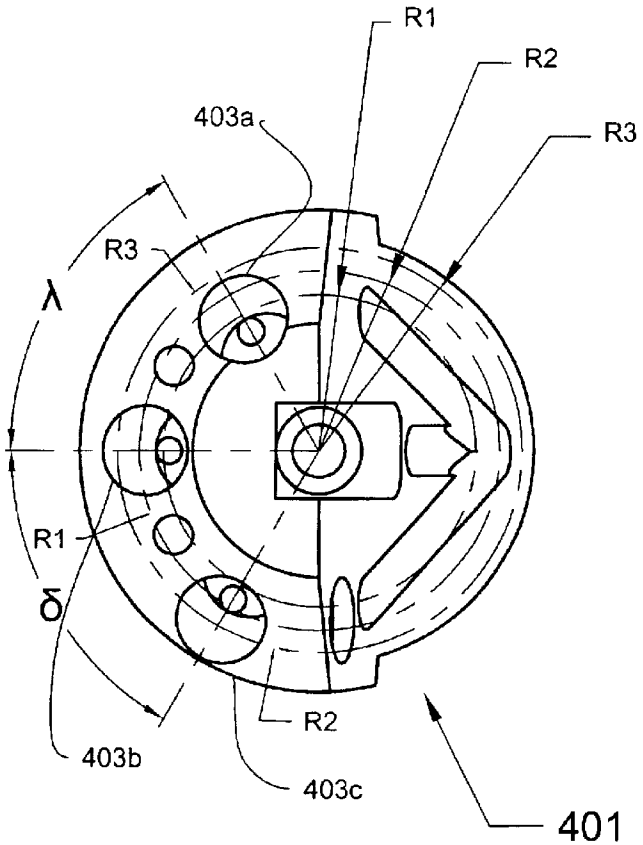
FIG. 6*g* depicts a front end view (distal end) of an example steerable horizontal subterranean drill bit without cutting teeth or elevated wear protectors.

FIG. 6*g* depicts a front end view (distal end) of a steerable horizontal subterranean drill bit 401 without cutting teeth or elevated wear protectors. The receptacles 403*a*, 403*b* and 403*c* for cutting teeth are shown, each being laid on out on its own circle of radius R1, R2 and R3 respectively, where R1<R2<R3 to achieve cutting path offset. The consequence of this is that the cutting teeth progressively cut, or overlap to a certain extent in their cutting pattern. This promotes even wear among the cutting teeth, for without a progressive cutting pattern, the leading cutting tooth would do most of the work and receive most of the wear.

FIG. 6*h* depicts a top view of a steerable horizontal subterranean drill bit 401 without cutting teeth or elevated wear protectors but including the receptacles 670 for the elevated wear protectors that protect the intersection of the steering face and the shank from undue wear.

Figure 7:
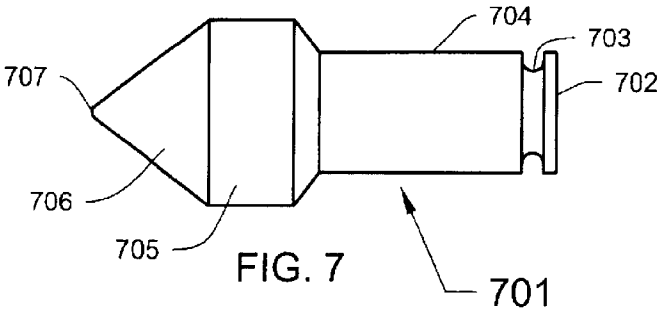
FIG. 7 depicts an example cutting tooth usable with a steerable horizontal subterranean drill bit.

FIG. 7 depicts an example cutting tooth 701 usable with a steerable horizontal subterranean drill bit. The cutting tooth 701 includes a base 702 at its proximal end, a channel 703 for placement of an o-ring thereon, a shank 704 that is cylindrical in shape, a cylindrical cutting skirt 705 at its distal end, the cutting skirt having a larger diameter than the shank, a conical cutting face 706 and point 707.

Figure 8:
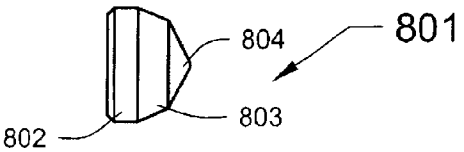
FIG. 8 depicts an example elevated wear protector usable with a steerable horizontal subterranean drill bit.

FIG. 8 depicts an example elevated wear protector 801 usable with a steerable horizontal subterranean drill bit. The wear protector 801 includes a cylindrical portion 802 for placement in a receptacle of a bit, a tapered portion 803 and a conical section 804 terminating in a point.

Figure 9B:
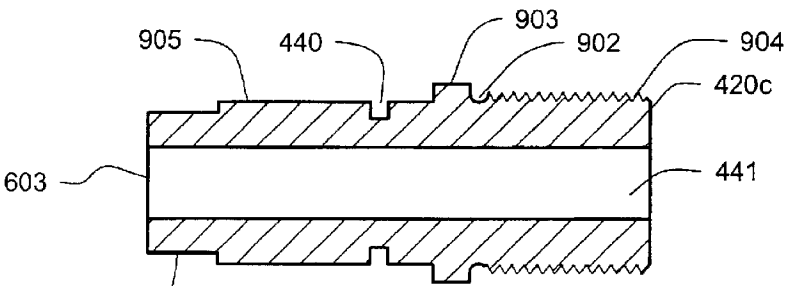
FIG. 9*b* depicts a cross sectional side of an example locating stud that has a drilling fluid flow channel and being usable with a steerable horizontal subterranean drill bit.
Figure 9A:
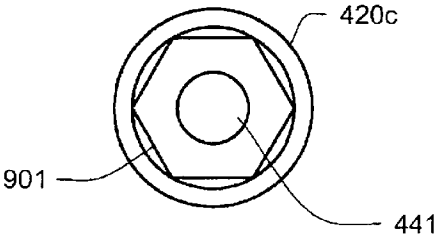
FIG. 9*a* depicts a proximal end view of an example locating stud having a drilling fluid flow channel and being usable with a steerable horizontal subterranean drill bit.

FIG. 9*a* depicts a proximal end view of a locating stud or bolt 420*c* having a drilling fluid flow channel 441, wrench flats 901 and aperture 603 (not shown) and being usable with a steerable horizontal subterranean drill bit.

FIG. 9*b* depicts a cross-sectional view of the same bolt. The bolt 420*c* may be threaded 904 for mounting in a receptacle on a drill bit. Proximal to the threads is a relief groove 902 and a shoulder 903. The shoulder seats against the drill bit mounting face to seal and protect the threads. A groove 440 on the bolt shank 905 is provided for a seal, such as an o-ring. Wrench flats 901 are provided for tightening the bolt 420*c* in a receptacle. A cylindrical shank portion 905 is provided to insert into a receptacle of a housing and bear thereagainst to positively locate the bolt therein.

Figure 10B:
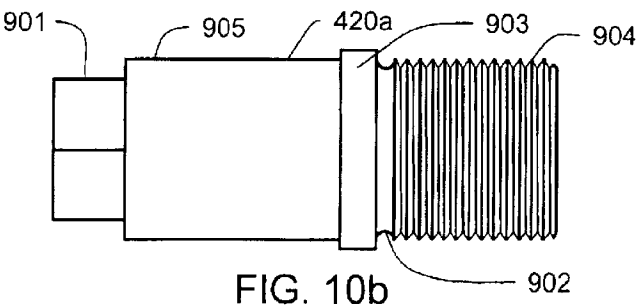
FIG. 10*b* depicts a side view of an example locating stud usable with a steerable horizontal subterranean drill bit.
Figure 10A:
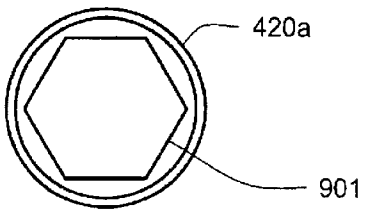
FIG. 10*a* depicts a proximal end view of an example locating stud usable with a steerable horizontal subterranean drill bit.

FIG. 10*a* depicts a proximal end view of a locating stud 402*a* usable with a steerable horizontal subterranean drill bit. FIG. 10*b* depicts a side view of the same stud 402*a*. Its structures were previously explained.

Figure 11A:
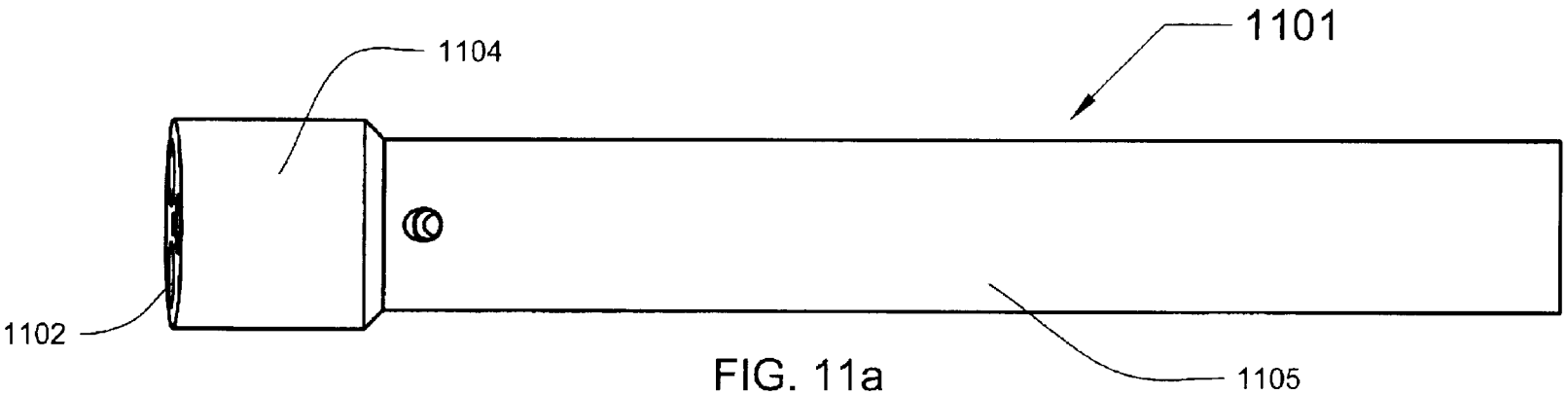
FIG. 11*a* depicts a side view of an example housing usable with a steerable horizontal subterranean drill bit.
Figure 11B:
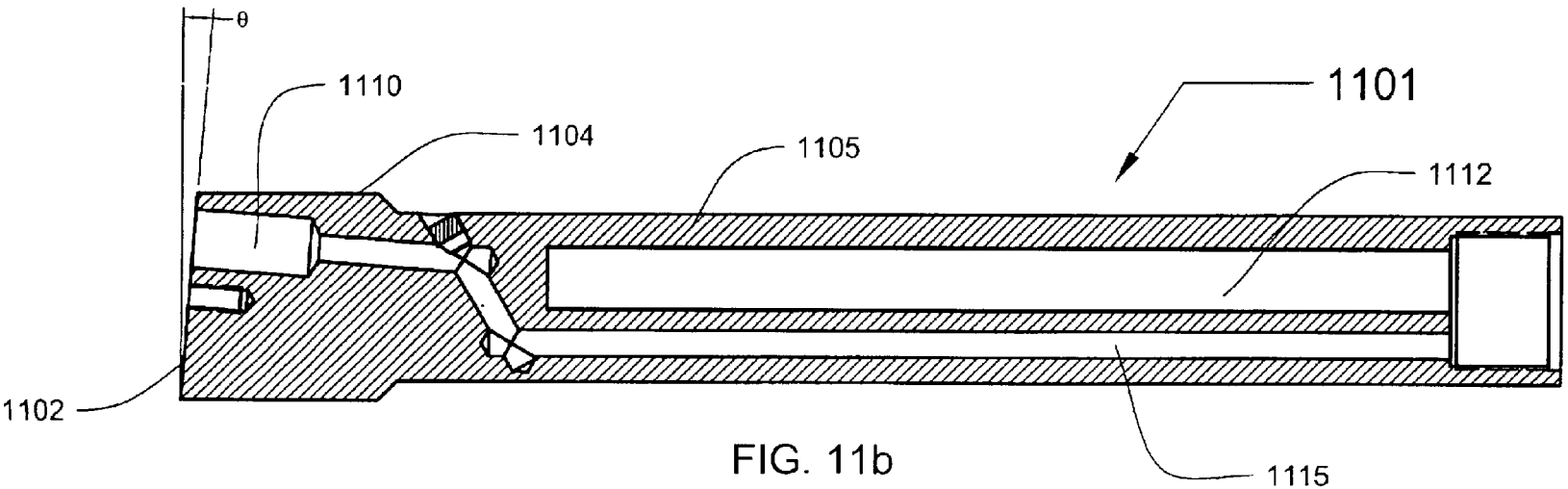
FIG. 11*b* depicts a cross sectional side view of an example housing usable with a steerable horizontal subterranean drill bit.

FIG. 11*a* depicts a side view of a housing 1101 usable with a steerable horizontal subterranean drill bit. FIG. 11*b* depicts a cross sectional view of the same housing. The housing 1101 has an elongate shank 1105 that terminates in a cylindrical enlarged head 1104 at its distal end. The head 1104 has a diameter that is greater than the diameter of the shank 1105. The head 1104 has a mounting face 1102 for mounting a drill bit thereagainst. The head 1104 portion is enlarged to accommodate receptacles 1110 for locating studs from the drill bit. Within the housing 1101, there is a cavity 1112 for housing electronics that permit a bit locator to communicate with and locate the bit. There is also a drilling fluid passageway 1115 that proceeds to a receptacle 1110 for a locating bolt from a drill bit to permit drilling fluid to move from the housing to the drill bit. The housing can receive drilling fluid from a drilling rig. The mounting face 1102 of the housing 1101 may be offset from orthogonal to the longitudinal axis of the housing by an angle θ. Angle θ may be any desired angle, such as 1 degree, 2 degrees, 3 degrees, 1–10 degrees, 2–20 degrees, etc., to achieve a cutting pattern of the drill bit cutting teeth that is greater in diameter than the drill bit or the housing.

Figure 11D:
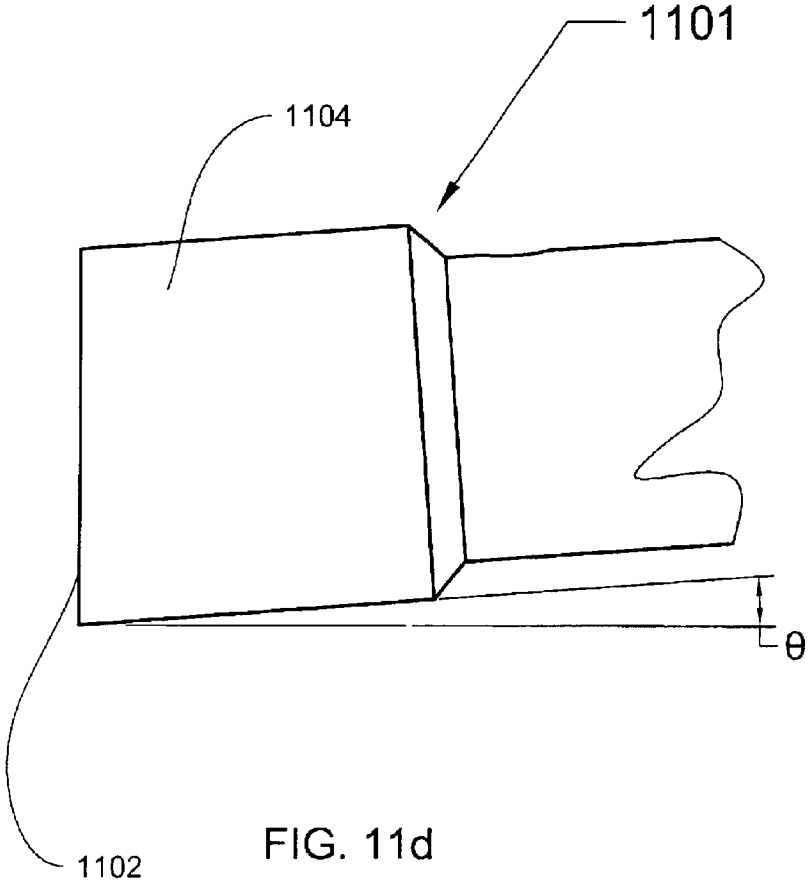
FIG. 11*d* depicts a side view of the distal end of an example housing usable with a steerable horizontal subterranean drill bit.
Figure 11C:
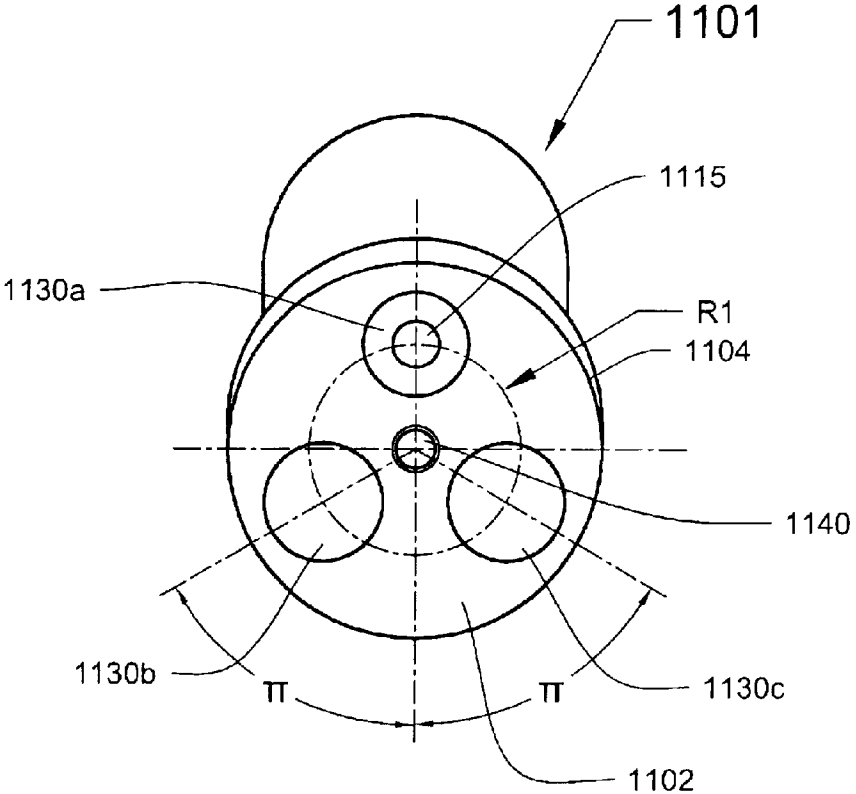
FIG. 11*c* depicts a distal end view of an example housing usable with a steerable horizontal subterranean drill bit.

FIG. 11*c* depicts a distal end view of the housing 1101 and FIG. 11*d* depicts a distal side view of the same. It can be seen that the mounting face 1102 and head 1104 include receptacles 1130*a*, 1130*b* and 1130*c* for receiving locating bolts or studs from a drill bit and positively fixing the angular position of the housing and drill bit with respect to each other. A centrally located bore 1140 is provided so that a one bolt attachment may project through the drill bit into the housing. The bore 1140 may be threaded. In combination with the locating studs, a single bolt thus holds the drill bit to the housing.

Figure 12A:
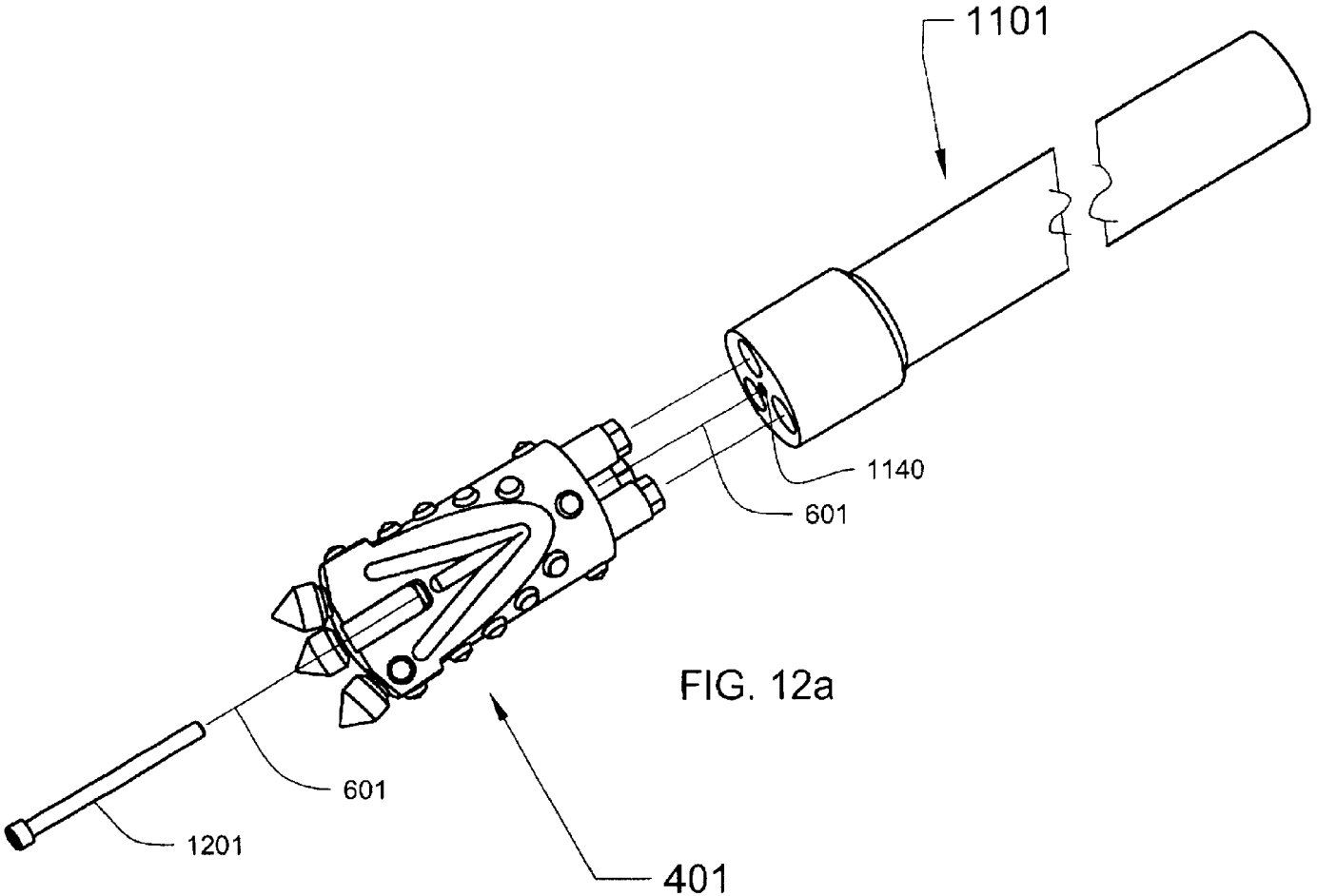
FIG. 12*a* depicts a parts explosion showing an example steerable horizontal subterranean drill bit with one bolt attachment and example housing.

FIG. 12*a* depicts a parts explosion showing a steerable horizontal subterranean drill bit 401 with one bolt attachment and housing 1101. A single bolt 1201 projects through the bore of the bit 401 and into the bore 1140 of the housing 1101 to attach the bit to the housing. The bolt 1201 could be located coincident with the axis 601 of the bit or with the axis of the housing 1101 if desired. The locating studs will then be held in their receptacles in the housing and the relative angular positions of the bit and housing will be fixed with respect to each other.

Figure 12B:
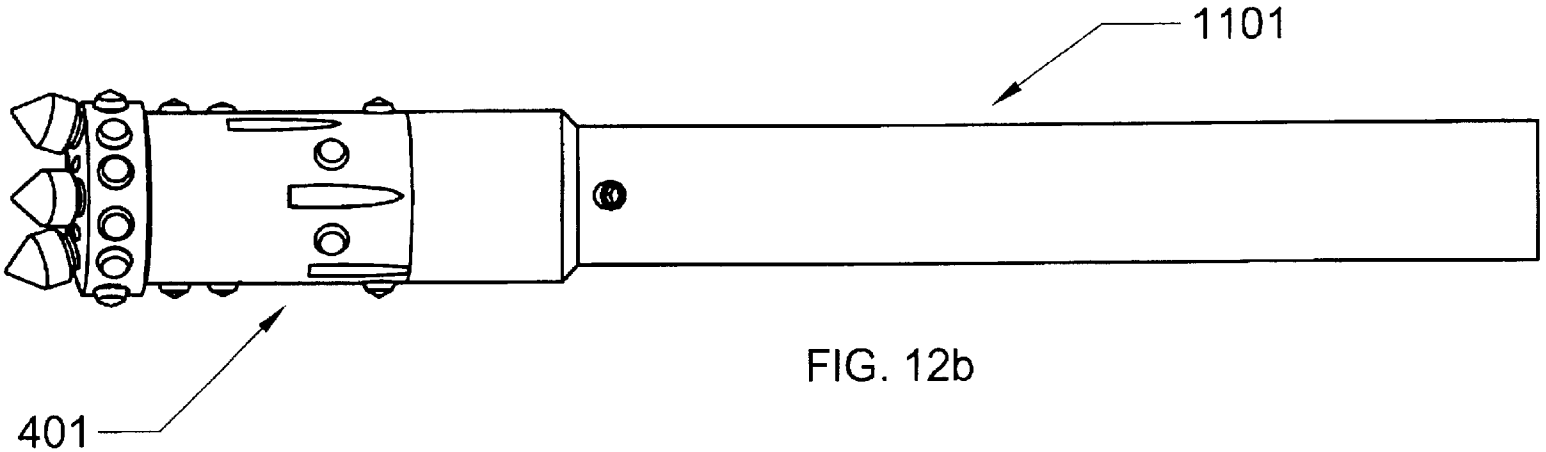
FIG. 12*b* depicts a bottom view of an example steerable horizontal subterranean drill bit installed with an example housing.

FIG. 12*b* depicts a bottom view of a steerable horizontal subterranean drill bit 401 installed with a housing 1101.

Figure 12C:
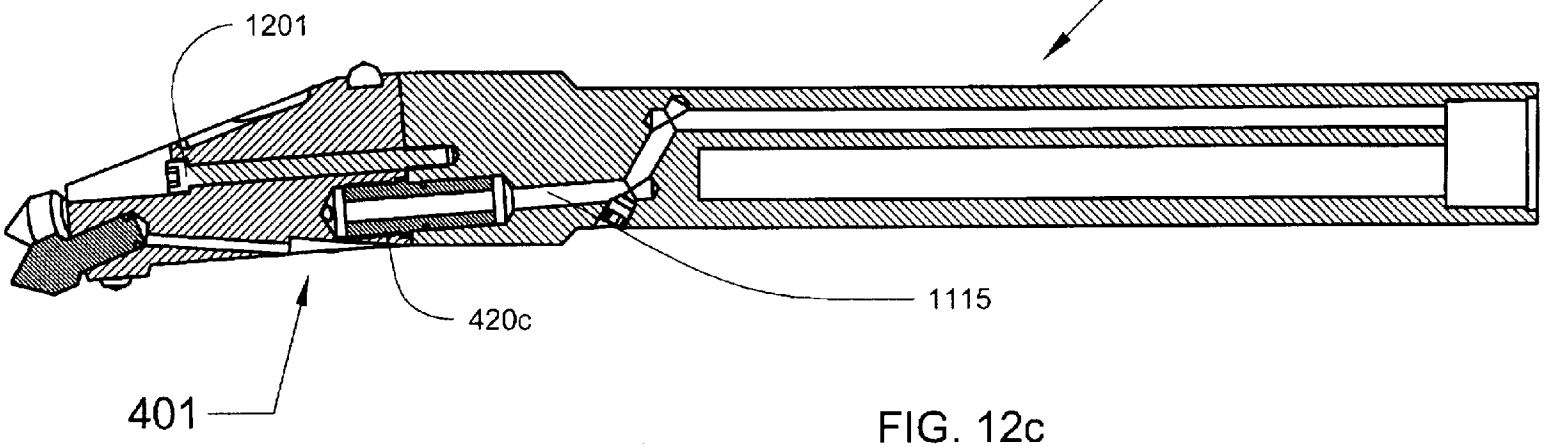
FIG. 12*c* depicts a cross sectional side view of an example steerable horizontal subterranean drill bit installed with an example housing.

FIG. 12*c* depicts a cross sectional side view of a steerable horizontal subterranean drill bit 401 installed with a housing 1101 using a one bolt attachment 1201. Drilling fluid flow pathway 1115 from the housing to the stud 420*c* and the bit is depicted.

Figure 13B:
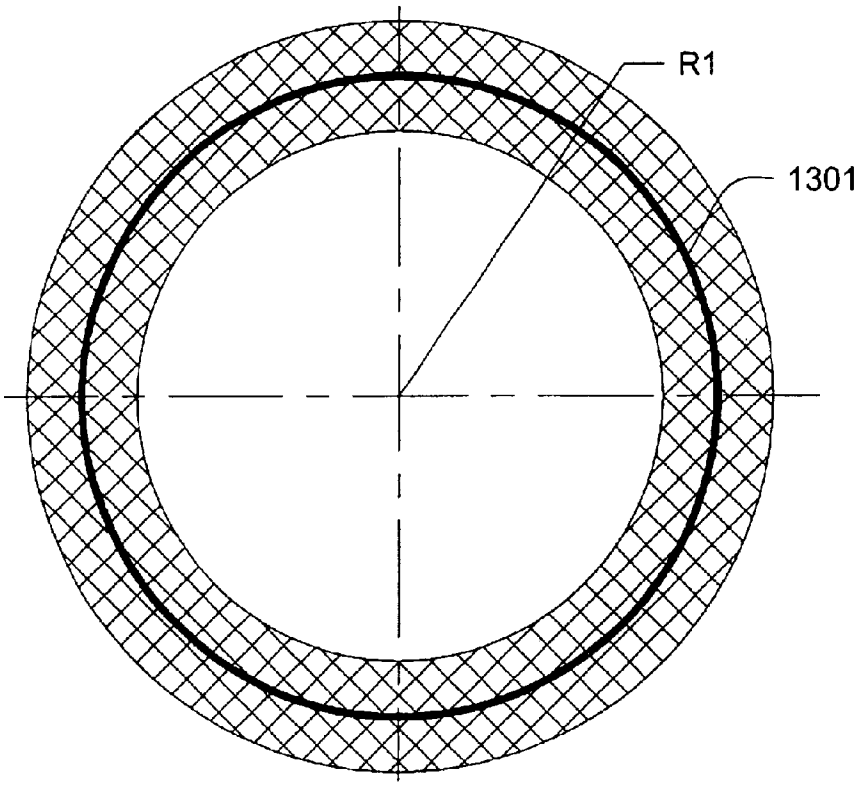
FIG. 13*b* depicts the cutting path which results from rotating the bit of FIG. 13*a* about its longitudinal axis.
Figure 13A:
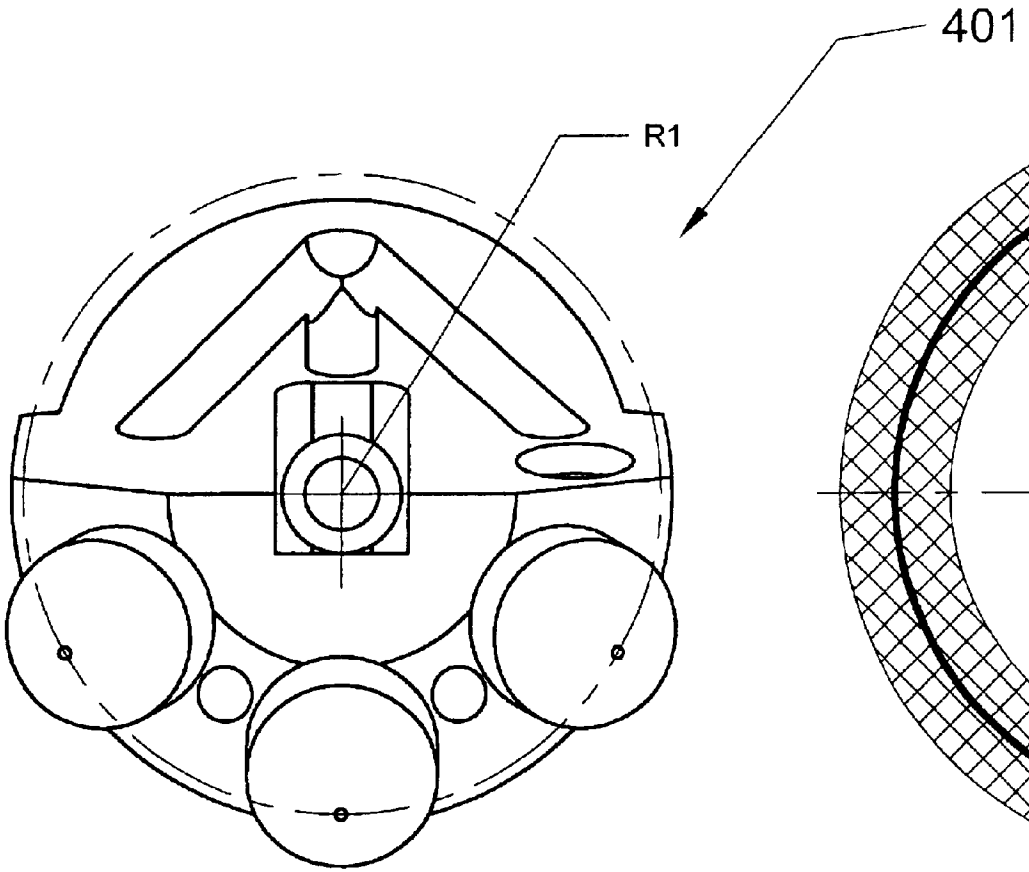
FIG. 13*a* depicts a front end view (distal side) of an example steerable horizontal subterranean drill bit with each of the cutting teeth installed on the circumference of a circle of radius R1.

FIG. 13*a* depicts a front end view (distal side) of a steerable horizontal subterranean drill bit 401 with each of the cutting teeth installed on the circumference of a single circle of radius R1. This is to be distinguished from the offset tooth pattern of FIG. 6*g* above. FIG. 13*b* depicts the cutting path 1301 which results from rotating the bit of FIG. 13*a* about its longitudinal axis.

Figure 14B:
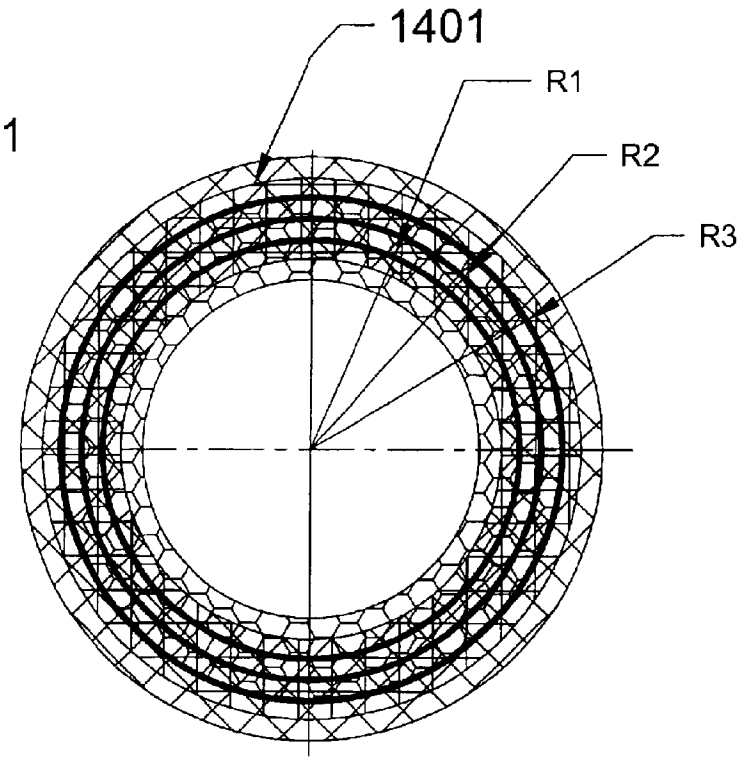
FIG. 14*b* depicts the overlapping and cutting paths which result from rotating the bit of FIG. 14*a* about its longitudinal axis.
Figure 14A:
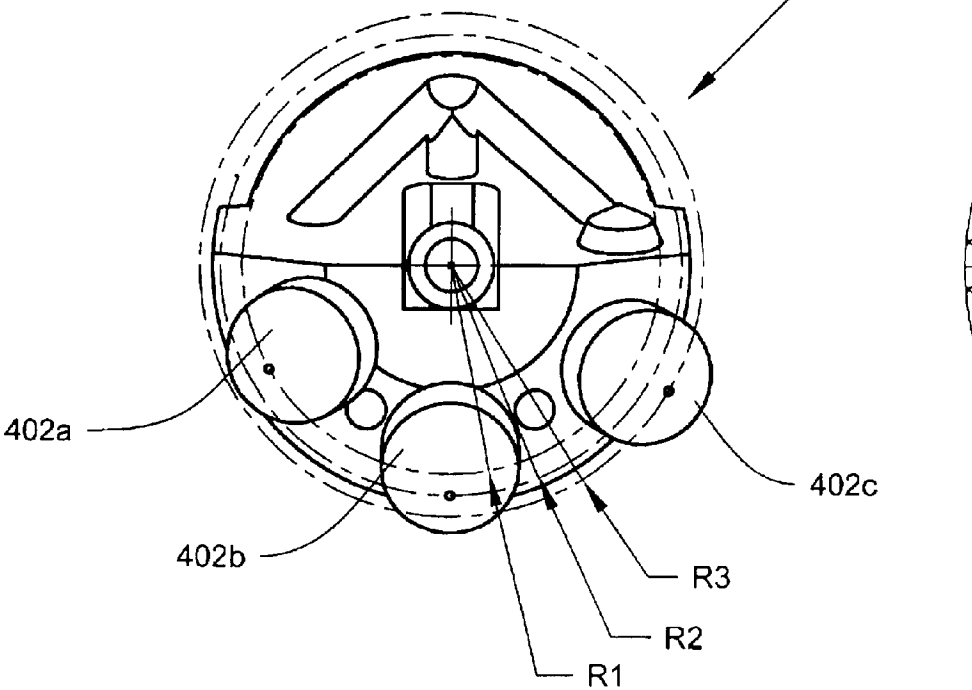
FIG. 14*a* depicts a front end view (distal side) of an example steerable horizontal subterranean drill bit with each of the cutting teeth installed on the circumference of three different circles having radii R1, R2 and R3, where R1<R2<R3.

FIG. 14*a* depicts a front end view (distal side) of a steerable horizontal subterranean drill bit 401 with each of the cutting teeth 402*a*, 402*b*, 402*c* installed on the circumference of three different circles having radii R1, R2 and R3, where R1<R2<R3 in offset orientation. R1, R2 and R3 may be chosen so that there is a 5–95% (or otherwise) overlap in cutting paths of the cutting teeth. FIG. 14*b* depicts the overlapping cutting paths 1401 which result from rotating the bit of FIG. 14*a* about its longitudinal axis.

Figure 15B:
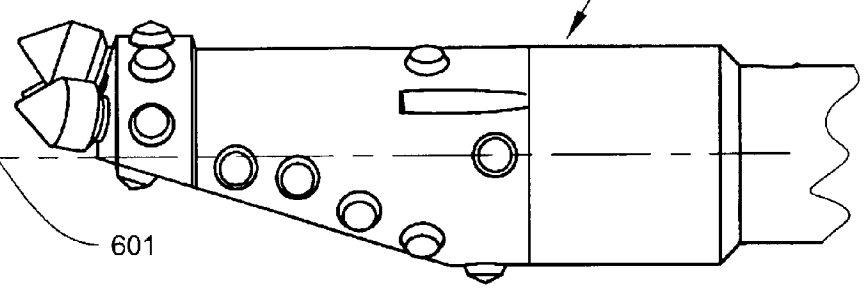
FIG. 15*b* depicts a side view of the bit of FIG. 15*a* installed with a housing so that their longitudinal axes are coincident.
Figure 15A:
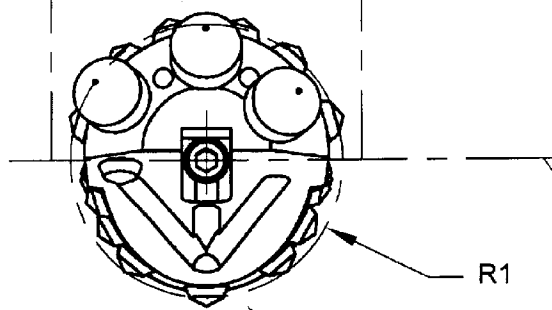
FIG. 15*a* depicts a front end view (distal side) of an example steerable horizontal subterranean drill bit that has been mounted with its longitudinal axis in-line with the longitudinal axis of a housing, and which when rotated about its longitudinal axis results in a hole of radius R1 being bored.

FIG. 15*a* depicts a front end view (distal side) of a steerable horizontal subterranean drill bit 401 that has been mounted with its longitudinal axis in-line with the longitudinal axis of a housing, and which when rotated about its longitudinal axis results in a hole of radius R1 being bored. FIG. 15*b* depicts a side view of the bit 401 of FIG. 15*a* installed with a housing so that their longitudinal axes 601 are coincident (no angular offset of bit or housing mounting faces). Circle R1 may be approximately the same dimension as the exterior measurement of the bit and cutting teeth.

Figure 16B:
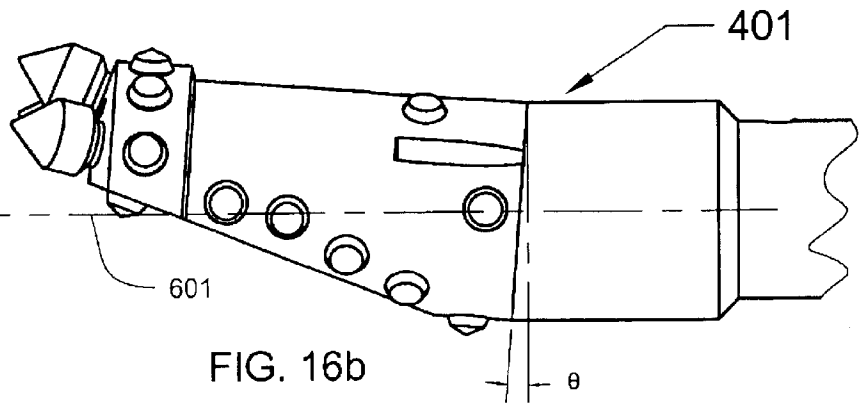
FIG. 16*b* depicts a side view of the bit of FIG. 16*a* installed with a housing so that the longitudinal axes of the has an angular offset θ resulting in a spinning path of the drill bit that is of greater dimension (R2) that the dimension it would possess without such angular offset.
Figure 16A:
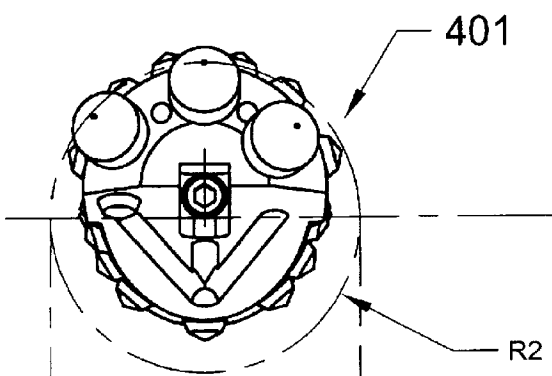
FIG. 16*a* depicts a front end view (distal side) of an example steerable horizontal subterranean drill bit that has been mounted with its longitudinal axis offset slightly from the longitudinal axis of a housing, and which when rotated about its longitudinal axis results in a hole of radius R2 being bored, where R2>R1 from FIG. 15*a* above.

FIG. 16*a* depicts a front end view (distal side) of a steerable horizontal subterranean drill bit 401 that has been mounted with its longitudinal axis offset slightly at an angle θ from the longitudinal axis 601 of a housing, and which when rotated about its longitudinal axis results in a hole of radius R2 being bored, where R2>R1 (from FIG. 15*a* above). FIG. 16*b* depicts a side view of the bit 401 of FIG. 16*a* installed with a housing so that the longitudinal axes of the has an angular offset θ resulting in a spinning path of the drill bit that is of greater dimension (R2) than the dimension it would possess without such angular offset. The offset may be found in the bit mounting face, the housing mounting face, or both. This technique permits the bit to bore a larger diameter hole that the bit's exterior dimension.

Figure 17B:
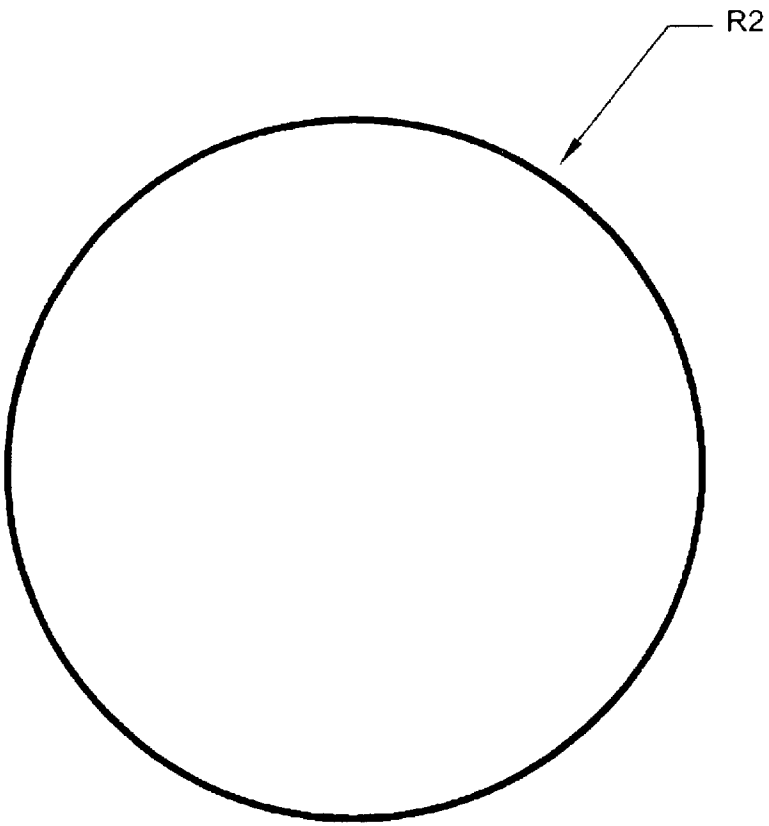
FIGS. 17*a* and 17*b* depict holes R1 and R2 bored by drill bits disclosed herein.
Figure 17A:
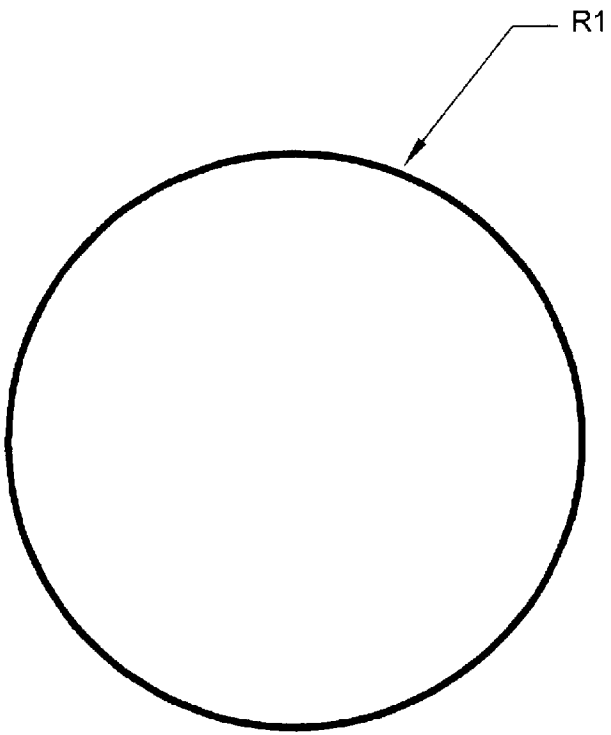

FIG. 17*a* depicts a hole of radius R1 bored by the bit of FIG. 15*a*, and FIG. 17*b* depicts a hole of radius R2 bored by the bit of FIG. 16*a*, where R2<R1 as result of offset θ in the bit of FIG. 16*a*.

One Bolt Attachment System.

The one bolt attachment system uses a single bolt projecting through a bore in the drill bit to thread into and tighten with a bore in the housing. The bores may be coincident with the longitudinal axes of the housing and drill bit, or otherwise. When locating studs are used to fix the angular position of the bit with respect to the housing, only a single centrally located bolt is needed to attach the bit to the housing. The bolt is located within bore out of the way of any cutting teeth or wear surfaces so that neither the bolt not the structure of the bit adjacent the bolt will experience wear or fail. This results in a much longer lasting drill bit.

Drilling Fluid Seal Assembly.

Drilling fluid moves from the housing into a bore in a locating stud/bolt, and from that bore into fluid flow channels of the bit. The stud/bolt has a receptacle, such as a channel, on it for receiving a seal such as an o-ring. The location of the seal receptacle/channel may be offset from the plane where the mounting face of the drill bit mates with the mounting face of the housing. This offset prevents dirt or debris from reaching the seal, preventing seal damage and avoiding leakage of drilling fluid.

Proportion of Bit Occupied by Elevated Wear Protectors.

It has been found that various portions of the drill bit are subject to severe conditions and hence potentially rapid wear. Such portions of the drill bit include the leading corner of the steering face, all exposed edges (such as the parabolic intersection of the steering face with the shank portion of the drill bit), the crown and the bores which facilitate cutting tooth removal. In order to reduce wear in these areas, elevated wear protectors are installed.

However, even when elevated wear protectors are installed, wear of certain portions of the drill bit can proceed at an undesirably rapid rate. Further experimentation and evaluation has revealed that when elevated wear protectors occupy at least a minimum percentage of the surface area of various sections of the drill bit, unwanted wear will fall dramatically.

In one embodiment, a drill bit was fabricated having an unprotected shank area (excluding steering face) of approximately 58 square inches (52 square inches of shank area excluding receptacles for elevated wear protectors). Thirteen (13) elevated wear protectors occupying about 6.54 square inches of area were installed in the shank area, resulting in 12.58% of the shank being covered by elevated wear protectors.

The crown area of the same drill bit had a surface area of that was not protected of 7.65 square inches (about 9.5 square inches including receptacles for elevated wear protectors). Six (6) elevated wear protectors were installed in the crown area yielding 39.47% of the crown surface area being covered by wear protectors.

This particular drill bit had about 16% of its total crown and shank areas covered by elevated wear protectors.

Of course, many variations of this concept are possible. The inventor contemplates that elevated wear protectors could cover less than 5%, more than 5%, about 8%, about 10%, bout 12%, about 15%, about 20%, about 25%, about 30%, about 35%, about 40%, about 50%, or more than 50% of the surface area of any part of the drill but, such as the crown, shank, steering face or total. The desirability of covering more of the drill bit with elevated wear protectors should be balanced against possible bit fragility as the receptacles are formed and detract from the structural integrity of the bit.

Offset Cutting Paths.

The cutting teeth of the cutting face of the drill bit may be offset with respect to each other, so that each is on the circumference of a progressively larger or progressively smaller circle than the cutting tooth before it. The cutting teeth may overlap by a small or a large margin. The overlap permits them to share the cutting burden, rather than placing the entire cutting burden on the first tooth.

Offset Mounting Face(s).

The mounting face(s) of the bit and/or the housing may be offset to yield a larger bore cut diameter than the diameter of either the drill bit or the housing.

Methods for Making a Steerable Horizontal Subterranean Drill Bit.

Various manufacturing techniques may be used to create a steerable horizontal subterranean drill bit. Such manufacturing processes include CNC milling, computer aided machining (CAM), electro discharge machining (EDM), wire EDM, photo chemical machining, hand milling, water jet machining, hydro abrasive machining, diamond machining, laser machining, forging, extrusion, casting or by any other suitable manufacturing method. Manufacturing the drill bit may include any or al of the following steps: (a) forming a steerable horizontal subterranean drill bit shank, (b) forming a drill bit steering face, (c) forming a drill bit mounting face, (d) forming a drill bit crown, (e) forming a drill bit cutting face, (e) forming drilling fluid flow channels, (f) forming locator pin receptacles, (g) forming cutting tooth knock-out pin bore holes, (h) forming cutting teeth receptacles, (i) forming elevated wear protector receptacles, (j) forming bore for one bolt attachment system, (k) forming locator pins, (l) forming or obtaining a housing, (m) forming or obtaining elevated wear protectors, and (n) forming or obtaining cutting teeth. In addition, hard facing may be applied to exterior surfaces of the drill bit, if desired, after final manufacturing, in order to increase the exterior hardness of the drill bit and improve its wear properties.

Materials.

Drill Bit.

The steerable horizontal subterranean drill bit may be of unitary construction and constructed from a material hard enough to endure the significant forces of drilling, and able to withstand substantial heat and abrasion. An example material from which the drill bit may be made is 4140 annealed steel, although other steel and other metals may also be used to make the drill bit.

The steel of the drill bit may be heat treated or annealed to improved its hardness or wear properties. It may also be cryogenically treated to enhance its density and improve its hardness and durability. Heat treating and cryogenic treating may occur before the drill bit is machined or after it is machined. The advantage of delaying heat treating and cryogenic treatment until after machining is that the machining will be easier on untreated steel. The disadvantage is that heat treating and cryogenic treating may cause some slight dimensional changes in the drill bit. If cryogenic treatment is performed after machining, it will tend to remove residual stresses from the drill bit which otherwise could result in warping or distortion of the bit under load and heat. One method for cryogenically treating the steel involves freezing it to a very low temperature and allowing it to return to room temperature twice. This tends to contract and compact the steel molecules, resulting in a denser and more durable steel.

Cutting Teeth.

Cutting teeth may be hard and durable to provide suitable subterranean drilling. Heat and abrasion resistance are crucial to the success of cutting teeth. The cutting teeth are easily replaceable in case of wear or breakage as long as the drill bit is not damaged. In one embodiment, the teeth are attached to the drill bit via the teeth receptacles in the drilling face. Cutting teeth can be made using various suitable materials including tungsten carbide, Various alternative types of superhard materials can be used, for example cubic boron carbonitride, cubic boron nitride, hexagonal boron nitride, polycrystalline diamond, monocrystalline diamond, diamond deposited by a chemical, physical or vapor deposition process, quartz, cubic $ZrO_2$, ultrahard fullerite, steel, titanium alloys, or other metals, hard materials or superhard materials. As depicted in the figures, the teeth may be frictionally held in place in receptacles on the drill bit cutting face. Alternatively, the teeth may be retained on the drill bit press fit, solder, brazing, welding, epoxy, threads, pins any other mechanical, frictional, structural or chemical attachment means.

Elevated Wear Protectors.

The drill bit includes elevated wear protectors on the crown, shank and steering face. The elevated wear protectors need heat and abrasion resistance similar to the cutting teeth, and therefore can be made from the same materials, and can be attached via the same attachment means. Both the cutting teeth and the elevated wear protectors could be formed with the drill bit as a unitary component if desired. Such formation would result in a disposable drill bit, due to the difficult of replacing cutting teeth and elevated wear protectors.

Drilling Fluid Seal Assembly.

As depicted in the figures, the drilling fluid seal assembly includes a seal (an o-ring as shown, but possibly of other construction) that must be able to withstand substantial hydraulic pressure in order to maintain an adequate seal. Materials that may be considered for such application include rubber, plastic, polyethylene, polypropylene, or any other polymer. O-rings are generally fabricated by injection mold machines, however alternative methods of manufacturing are available.

While the present devices and structures have been described and illustrated in conjunction with a number of specific embodiments, those skilled in the art will appreciate that variations and modifications may be made without departing from the principles that are herein illustrated and described.

The devices and structures may be embodied in other specific forms without departing from its spirit or essential characteristics. The described embodiments are to be considered in all respects as only illustrative, and not restrictive. The scope of the invention is, therefore, indicated by the appended claims, rather than by the foregoing description. All changes which come within the meaning and range of equivalency of the claims are to be embraced within their scope.

What is claimed is:

1. A steerable horizontal subterranean drill bit apparatus having an offset cutting tooth path, the apparatus comprising:

a steerable horizontal subterranean drill bit, a drill bit proximal end which is attachable to a housing, a drill bit distal end suitable for use in subterranean drilling, a longitudinal axis between said proximal and distal ends, a drill bit mounting face located at said drill bit proximal end, said mounting face being generally planar, said drill bit mounting face serving to abut against a housing to which said drill bit may be mounted, said drill bit mounting face including a plurality of stud receptacles therein, a plurality of locating studs mounted in said receptacles, said locating studs serving to project into holes on a housing and to bear against such holes in order to positively engage with a housing and fix the angular position of the drill bit with respect to the housing, a drill bit shank adjacent said mounting face, said shank being at least partially cylindrical in shape, said shank cylindrical portion having a longitudinal axis coincident with said drill bit longitudinal axis, said shank cylindrical portion having a radius $R_{shank}$ said shank having a plurality of receptacles for receiving elevated wear protectors, a drill bit steering face, said steering face being situated along said drill bit shank in an angular orientation with respect to said drill bit longitudinal axis, said steering face having a leading edge, said steering face having at least one receptacle for receiving at least one elevated wear protector therein, said steering face elevated wear protector receptacle being located in the vicinity of said leading edge, an elevated wear protector located in said steering face leading edge receptacle, said steering face leading edge elevated wear protector serving to protect said steering face leading edge from abrasive wear, at least some of said shank elevated wear protector receptacles being located along said steering face to shank parabolic intersection, said shank elevated wear protector receptacles having elevated wear protectors installed therein, said elevated wear protector receptacles serving to protect against abrasive wear, a crown located adjacent said shank and adjacent said steering face, said crown being located closer to said drill bit distal end than said shank, said crown having a plurality of receptacles thereon for placement of elevated wear protectors therein, said crown having an exterior surface that is at least partially cylindrical in shape, said crown cylindrical portion with radius $R_{crown}$, said radius $R_{crown}$ being greater than said radius $R_{shank}$, a cutting face located at said drill bit distal end, said cutting face having a plurality of receptacles for receiving cutting teeth therein, each of said cutting face receptacles being situated at an angular orientation with respect to said drill bit longitudinal axis that is neither parallel nor perpendicular to said drill bit longitudinal axis, each of said cutting face receptacles being situated at an angular orientation with respect to each of said other cutting face receptacles so that no cutting face receptacle longitudinal axis is parallel to any other cutting face receptacle longitudinal axis, a plurality of cutting teeth located in said cutting face receptacles, the number of said cutting teeth being represented by the letter "i" where "i" is an integer, said cutting teeth being situated so that when the drill bit is rotated about its longitudinal axis, each cutting tooth "i" circumscribes a circle $C_i$, where each such circle $C_i$ is defined by a radius R1, such that each R1 is not equal to $R_{i+1}$, so that when the drill bit is rotated about its longitudinal axis, the cutting teeth define a cutting path that includes offset overlapping cutting tooth patterns, said drill bit mounting face being situated at an angular orientation with respect to said drill bit longitudinal axis that is selected to be an angular orientation other than perpendicular and parallel, so that when a housing to which the drill bit is affixed is rotated, each cutting tooth "i" moves in a manner that circumscribes a circle $C'_i$ where each such circle $C'_i$ is defined by a radius $R'_i$, such that for any cutting tooth "i", $R'_i$ is greater than R1, said circles $C'_i$ in aggregate presenting an offset and overlapping cutting path of said cutting teeth.

2. An apparatus as recited in claim 1 further comprising:

a housing, said housing including a proximal end, a distal end and a longitudinal axis, said housing having a shank portion located between said housing proximal end and said housing distal end, said housing having a mounting face located at said housing proximal end, said housing mounting face being generally planar in shape, said housing mounting face having a plurality of receptacles on said housing mounting face for receiving locating studs which would serve to positively fix the angular orientation of said drill bit with respect to said housing to which said drill bit may be attached, said sealing means being locatable in one of said housing mounting face receptacles to provide a drilling fluid seal, said sealing means being offset from the plane of said drill bit mounting face.

3. An apparatus as recited in claim 2 further comprising:

a bore in said housing for receiving a unitary one bolt attachment, and a unitary one bolt attachment, said one bolt attachment being capable of projecting through said drill bit bore into said housing bore to positively engage said housing and to fix the longitudinal position of said drill bit with respect to said housing.

4. An apparatus as recited in claim 1, further comprising a tripartite gel flow channel on said steering face.

5. An apparatus as recited in claim 1 wherein at least one of said elevated wear protectors has a material selected from the group consisting of tungsten carbide, cubic boron carbonitride, cubic boron nitride, hexagonal boron nitride, polycrystalline diamond, monocrystalline diamond, quartz, cubic zirconium oxide and ultrahard fullerite.

6. An apparatus as recited in claim 1 further comprising a V-shaped gel flow channel within said drill bit.

7. A steerable horizontal subterranean drill bit apparatus having a offset cutting tooth paths, the apparatus comprising:

a steerable horizontal subterranean drill bit, a drill bit proximal end which is attachable to a housing, a drill bit distal end suitable for use in subterranean drilling, a longitudinal axis between said proximal and distal ends, a drill bit mounting face located at said drill bit proximal end, said drill bit mounting face serving to mate with a housing, said drill bit mounting face including at least one stud receptacle therein, a plurality of locating studs mountable in said drill bit mounting face stud receptacle, said studs serving to project into a hole on a housing and to bear against such hole in order to positively engage with a housing and fix the angular position of the drill bit with respect to the housing, a drill bit shank adjacent said mounting face, said shank having a plurality of receptacles for receiving elevated wear protectors, a drill bit steering face, said steering face being situated along said drill bit shank in an angular orientation with respect to said drill bit longitudinal axis such that said steering face is neither parallel nor perpendicular to said drill bit longitudinal axis, a cutting face located at said drill bit distal end, said cutting face having a plurality of receptacles for receiving cutting teeth therein, a plurality of cutting teeth locatable in said cutting face receptacles, the number of said cutting teeth being represented by the letter "i" where "i" is an integer, said cutting teeth being situated so that when the drill bit is rotated about its longitudinal axis, each cutting tooth "i" circumscribes a circle $C_i$, where each such circle $C_i$ is defined by a radius $R_i$, such that for at least one $R_i$, $R_i$, is not equal to $R_{i+1}$, so that when the drill bit is rotated about its longitudinal axis, the cutting teeth define a cutting path that includes offset overlapping cutting tooth patterns.

8. An apparatus as recited in claim 7, wherein said drill bit mounting face is situated at an angular orientation with respect to said drill bit longitudinal axis that is selected to be an angular orientation other than perpendicular and parallel, so that when a housing to which the drill bit is affixed is rotated, each cutting tooth "i" moves in a manner that circumscribes a circle $C'_i$ where each such circle $C'_i$ is defined by a radius $R'_i$, such that for any cutting tooth "i", $R'_i$ is greater than $R_i$, said circles $C'_i$ in aggregate presenting an offset and overlapping cutting path of said cutting teeth.

9. An apparatus as recited in claim 7, wherein each of said cutting face receptacles is situated at an angular orientation with respect to said drill bit longitudinal axis that is neither parallel nor perpendicular to said drill bit longitudinal axis.

10. An apparatus as recited in claim 7, further comprising:

a bore through said drill bit, said drill bit bore having a first orifice in the vicinity of said drill bit mounting face, said drill bit bore having a second orifice which may be accessed from at least one of said steering face and said cutting face, said drill bit bore being configured to accommodate a one bolt attachment therethrough in order to secure the drill bit to a housing, said one bolt attachment serving to fix the longitudinal position of the drill bit with respect to a housing, and in combination with said locating studs, to positively engage a housing so that the drill bit may be used for drilling.

11. An apparatus as recited in claim 7, further comprising:

a fluid flow channel through at least one of said locating studs, said stud fluid flow channel serving to receive a drilling fluid from a housing to which the drill bit may be attached, a fluid flow channel through said drill bit, said fluid flow channel in said drill bit serving to receive drilling fluid from staid locating stud fluid flow channel and deliver the drilling fluid to said drill bit cutting face, and sealing means on said locating stud having a fluid flow channel, said sealing means being set apart and offset from said drill bit mounting face so that when the drill bit is affixed to a housing, said sealing means is located within the housing to achieve a fluid seal with the housing that is not in the mounting plane of the drill bit mounting face to the housing.

12. An apparatus as recited in claim 11, said sealing means being locatable in one of said housing mounting face receptacles to provide a drilling fluid seal, said sealing means being offset from the plane of said drill bit mounting face.

13. An apparatus as recited in claim 7, further comprising a gel flow channel on said steering face.

14. An apparatus as recited in claim 9 further comprising sealing means on said locating stud having a fluid flow channel, said sealing means being set apart and offset from said drill bit mounting face so that when the drill bit is affixed to a housing, said sealing means is located within the housing to achieve a fluid seal with the housing that is not in the mounting plane of the drill bit mounting face to the housing.

15. A steerable horizontal subterranean drill bit apparatus having offset cutting tooth paths, the apparatus comprising:

a steerable horizontal subterranean drill bit, a drill bit proximal end which is attachable to a housing, a drill bit distal end suitable for use in subterranean drilling, a longitudinal axis between said proximal and distal ends, a drill bit mounting face located at said drill bit proximal end, said drill bit mounting face serving to mate with a housing, said drill bit mounting face including at least one stud receptacle therein, a plurality of locating studs mountable in said drill bit mounting face stud receptacle, said studs serving to project into a hole on a housing and to bear against such hole in order to positively engage with a housing and fix the angular position of the drill bit with respect to the housing, a drill bit shank adjacent said mounting face, a drill bit steering face, said steering face being situated between said drill bit proximal and distal ends, said steering face being situated in an angular orientation with respect to said drill bit longitudinal axis such that said steering face is neither parallel nor perpendicular to said drill bit longitudinal axis, a cutting face located at said drill bit distal end, said cutting face having a plurality of receptacles for receiving cutting teeth therein, a plurality of cutting teeth locatable in said cutting face receptacles, the number of said cutting teeth being represented by the letter "i" where "i" is an integer, said cutting teeth being situated so that when the drill bit is rotated about its longitudinal axis, each cutting tooth "i" circumscribes a circle $C_i$, where each such circle $C_i$ is defined by a radius $R_i$, such that for at least one $R_i$, $R_i$, is not equal to $R_i$, so that when the drill bit is rotated about its longitudinal axis, the cutting teeth define a cutting path that includes offset overlapping cutting tooth patterns.

16. An apparatus as recited in claim 15, wherein said drill bit mounting face is situated at an angular orientation with respect to said drill bit longitudinal axis that is selected to be an angular orientation other than perpendicular and parallel, so that when a housing to which the drill bit is affixed is rotated, each cutting tooth "i" moves in a manner that circumscribes a circle $C'_i$ where each such circle $C'_i$ is defined by a radius $R_i$, such that for any cutting tooth "i", $R'_i$ is greater than $R_i$, said circles $C'_i$ in aggregate presenting an offset and overlapping cutting path of said cutting teeth.

17. An apparatus as recited in claim 15, wherein at least two of said cutting face receptacles are situated at an angular orientation with respect to said drill bit longitudinal axis that is neither parallel nor perpendicular to said drill bit longitudinal axis.

18. An apparatus as recited in claim 15 wherein at least one of said elevated wear protectors has a material selected from the group consisting of tungsten carbide, cubic boron carbonitride, cubic boron nitride, hexagonal boron nitride, polycrystalline diamond, monocrystalline diamond, quartz, cubic zirconium oxide and ultrahard fullerite.

19. An apparatus as recited in claim 15 wherein said drill bit mounting face is situated at an angular orientation with respect to said drill bit longitudinal axis that is selected to be an angular orientation other than perpendicular and parallel.

20. An apparatus as recited in claim 15 further comprising an offset drilling fluid seal.

* * * * *